US007513261B2

(12) United States Patent
Ura

(10) Patent No.: US 7,513,261 B2
(45) Date of Patent: Apr. 7, 2009

(54) METHOD AND DEVICE FOR WASHING DRAIN PIPE

(76) Inventor: Kimasaru Ura, 2-3-52-703, Shiohama, Ichikawa-shi, Chiba (JP) 272-0127

( * ) Notice: Subject to any disclaimer, the term of this patent is extended or adjusted under 35 U.S.C. 154(b) by 588 days.

(21) Appl. No.: 10/807,923

(22) Filed: Mar. 24, 2004

(65) Prior Publication Data

US 2004/0261822 A1 Dec. 30, 2004

Related U.S. Application Data

(62) Division of application No. 09/890,943, filed on Aug. 6, 2001, now Pat. No. 6,772,774.

(51) Int. Cl.
*B08B 9/027* (2006.01)

(52) U.S. Cl. ..... 134/22.11; 134/22.12

(58) Field of Classification Search ..... 134/22.11, 134/22.12, 22.1, 24, 34
See application file for complete search history.

(56) References Cited

U.S. PATENT DOCUMENTS 4,687,011 A * 8/1987 Masaru ..... 134/167 C
4,848,380 A * 7/1989 Francis et al. ..... 134/22.12
5,018,545 A 5/1991 Wells
5,314,545 A * 5/1994 Folts et al. ..... 134/22.11
5,322,080 A 6/1994 Rankin
5,323,797 A * 6/1994 Rankin ..... 134/167 C
5,408,991 A * 4/1995 Iida et al. ..... 600/133

FOREIGN PATENT DOCUMENTS

| | | |
|---|---|---|
| JP | 49-37403 | * 10/1974 |
| JP | 01-315379 | * 12/1989 |
| JP | 07-055308 | * 6/1995 |
| JP | 08-187472 | 7/1996 |

* cited by examiner

*Primary Examiner*—Michael Barr
*Assistant Examiner*—Saeed T Chaudhry
(74) *Attorney, Agent, or Firm*—Husch Blackwell Sanders LLP Welsh & Katz

(57) ABSTRACT

A method and a device for washing a drain pipe allowing a nozzle to be rotated along the inner peripheral surface of a pipe even in a lateral pipe, wherein the positions of a plurality of injection holes (10, 11, 12, and 13) formed in the nozzle (1) are formed and the amount of high pressure water jetted from each of the injection holes (10, 11, 12, and 13) are regulated so that the specific injection hole (10) only among the plurality of injection holes is set so as to be opposed always to the inner peripheral surface (5a) of the pipe.

7 Claims, 29 Drawing Sheets

METHOD AND DEVICE FOR WASHING DRAIN PIPE

This application is divisional of application Ser. No. 09/890,943, filed Aug. 6, 2001, now U.S. Pat. No. 6,772,774.

TECHNICAL FIELD

This invention relates to improvements in a method and device for washing drain pipes for washing drain pipes and other pipeline facilities installed in apartment buildings, other buildings and the like.

BACKGROUND ART

A conventional head deployed on the end of a high pressure hose used in washing pipeline facilities is constituted by a nozzle having multiple injection holes made therein at a prescribed pitch about the circular circumference thereof for jetting high pressure water in a radiating manner obliquely rearward relative to the direction of advance of the jetted water, and a universal guide linked to the leading end of the nozzle.

As is disclosed in Japanese Utility Model Application Laid-open No. S55-20380 and Japanese Utility Model Publication No. S49-37403, such a high pressure hose is accommodated in a revolving drum and the high pressure hose is made to turn by turning the revolving drum.

The nozzle linked to the leading end of the high pressure hose described above, as indicated in Japanese Patent Application Laid-Open No. S54-110658, advances inside the drain pipe while turning, due to the propulsion produced by the high pressure water jetted from the nozzles and the operations of pulling out and turning the high pressure hose from the revolving drum, and the inner peripheral surfaces of the pipe are washed thereby.

The drain pipes subject to the washing described above may be largely categorized into vertical pipes and lateral pipes. When, using the conventional device for washing drain pipe described in the foregoing, a high pressure hose is made to turn inside a vertical pipe, thereby causing the nozzle linked to the leading end of that high pressure hose to turn, the nozzle turns along the inner peripheral surface of the vertical pipe.

When, in this condition, the high pressure hose is pulled out of the revolving drum a little at a time and fed into the vertical pipe, the nozzle advances while turning, in a spiral turning manner, along the inner peripheral surface of the vertical pipe, whereupon the solid material adhering to the inner peripheral surface of the vertical pipe is broken up and removed by the high pressure water jetted from the nozzle.

When the drain pipe is a lateral pipe, on the other hand, even if the high pressure hose is made to turn inside the lateral pipe, the nozzle will be acted on by its own weight toward the bottom of the pipe, wherefore it will not turn along the inner peripheral surface of the pipe.

Accordingly, when the drain pipe is a lateral pipe, when the high pressure hose is made to turn inside the lateral pipe, and the high pressure hose is pulled out from the revolving drum a little at a time and fed into the pipe, the nozzle will merely advance linearly along the bottom of the lateral pipe, there will be no spiral turning along the inner peripheral surface of the lateral pipe, and the washing force on the inner circumference surfaces of the lateral pipe will be particularly poor on the upper part of the lateral pipe. This constitutes a problem.

Also, the injection pressure of the high pressure water jetted from the injection holes in the nozzle declines the farther the injection holes are from the pipe wall, therefore making it difficult to break up the solid material adhering at the upper part of a lateral pipe, at positions far from the pipe bottom, with high pressure water. In order to break up that solid material, it is thought necessary to have equipment that delivers a larger quantity of water at higher pressures. In terms of this point also, conventional devices have not been able to wash pipe interiors evenly and efficiently.

Furthermore, the conventional nozzle described in the foregoing is structured so that it obtains a propulsive force due to the high pressure water jetted obliquely rearward, and is thus self-propelled, wherefore it is necessary first to pull the nozzle back when repeatedly washing a particular position in the pipe, for example. In such cases, however, the nozzle obtains great propulsive force due to the jetting of the high pressure water, making a large force necessary to pull it back, which constitutes an actual difficulty. Thereupon, conventionally, when repeatedly washing a particular position in a pipe, a complicated and troublesome procedure is required wherewith the jetting of the high pressure water is first terminated, the nozzle is then pulled back behind the certain position, and, thereafter, the high pressure water is again jetted obliquely rearward, causing the nozzle to be self-propelled, thus causing the nozzle to again pass over and wash the particular position that is the object of washing.

In recent years, moreover, when washing drain pipes in condominium buildings and the like, instead of inserting the nozzle into the drain pipe from a starting point that is the starting end (the starting end of the drain pipe connected to a waste water facility such as a sink or commode) of that drain pipe installed in each apartment, as conventionally, and then beginning the washing, the nozzle is being inserted into the drain pipe from a starting point that is a drain pipe in a drain pipe centralized control unit performing centralized deployment control on the back end of drain pipes extended from each apartment, whereupon the washing is begun toward the starting end of the drain pipe in each apartment.

When, in this manner, the washing of drain pipes is begun from the back end thereof, for each apartment, that is, in a drain pipe centralized control unit, drain pipe washing can be done simply, even when the resident of the apartment is not at home.

In such cases, when a conventional device for washing drain pipe is used, and a drain pipe is washed, jetting high pressure water in a radiating manner only obliquely rearward relative to the direction of nozzle advance, the structure is such that the nozzle is self-propelled toward the direction of advance by the reaction when that high pressure water impacts the pipe wall, wherefore a negative pressure is readily generated by the high pressure water being jetted obliquely rearward inside the drain pipe forward of the nozzle in the direction of advance thereof. That negative pressure causes water in the water trap valve at the starting end of the drain pipe of each apartment to be sucked in, and there is a danger that the water trap valve will be destroyed.

Such a water trap valve is ordinarily formed at the starting end of a drain pipe connected to a waste water facility such as a "sink or bath tub, etc." The water retained therein prevents outside air, and particularly odors and small animals and the like, from invading the apartment through the drain pipe. When this trap is destroyed, there is a danger that foul odors will pass through the drain pipe and fill the interior of the apartment.

Accordingly, a first object of the present invention is to provide a method and device for washing drain pipe wherewith a nozzle can be made to turn along the interior circumference surface of a pipe, even in a lateral pipe.

A second object of the present invention is to provide a method and device for washing drain pipe wherewith, not only can a nozzle be made to turn along the interior circumference surface of a pipe, even in a lateral pipe, but a specific position in the pipe can be repeatedly washed with a simple operation.

A third object of the present invention is to provide a method and device for washing drain pipe wherewith, not only can a nozzle be made to turn along the interior circumference surface of a pipe, even in a lateral pipe, but the water trap valve is not destroyed.

DISCLOSURE OF THE INVENTION

In order to attain the first object stated above, in a first method and device for washing drain pipe of the present invention, in a method of washing drain pipe wherewith a nozzle is provided at the leading end of a high pressure hose, a universal guide is linked to the leading end of that nozzle, high pressure water is jetted obliquely rearward from a plurality of injection holes opened in the nozzle, a propulsion force is generated in the nozzle by the jetting force, the high pressure hose is fed into a drain pipe while causing that high pressure hose to turn, and the interior of the pipe is washed by the high pressure water jetted from the nozzle, the nozzle is made to turn in a spiral manner along the inner peripheral surface of the pipe, in conjunction with the turning and pulling out of the high pressure hose, so that, of the plurality of injection holes, only a certain injection hole is always in opposition to the inner peripheral surface of the pipe.

In order to attain the second object stated above, moreover, in a second method and device for washing drain pipe of the present invention, in a method of washing drain pipe wherewith a nozzle is provided at the leading end of a high pressure hose, a universal guide is linked to the leading end of that nozzle, high pressure water is jetted from a plurality of injection holes opened in the nozzle, the high pressure hose is fed into a drain pipe while causing that high pressure hose to turn, and the interior of the pipe is washed by the high pressure water jetted from the nozzle, in addition to making the nozzle turn in a spiral manner, in conjunction with the turning, pulling out, and pulling back operations on the high pressure hose, so that, of the plurality of injection holes, only a certain injection hole is always in opposition to the inner peripheral surface of the pipe, the diameter of the certain injection hole is set larger than the diameters of the other injection holes, and the angle $\alpha$ subtended by the center axis line I of that certain injection hole and the center axis line H of the nozzle, and the angles $\beta$ subtended by the center axis line J of the other injection holes and the center axis line H of the nozzle, respectively, are set at 90 degrees.

In order to attain the third object stated above, moreover, in a third method and device for washing drain pipe of the present invention, in a method of washing drain pipe wherewith a nozzle is provided at the leading end of a high pressure hose, a universal guide is linked to the leading end of that nozzle, high pressure water is jetted from a plurality of injection holes opened in the nozzle, the high pressure hose is fed into a drain pipe while causing that high pressure hose to turn, and the interior of the pipe is washed by the high pressure water jetted from the nozzle, in addition to making the nozzle turn in a spiral manner, in conjunction with the turning and feeding operations on the high pressure hose, so that, of the plurality of injection holes, only a certain injection hole is always in opposition to the inner peripheral surface of the pipe, the diameter of the certain injection hole is set larger than the diameters of the other injection holes, the certain injection hole is formed so that the position thereof is farther rearward than the positions of the other injection holes as seen from the direction of advance of the nozzle, the angle $\alpha$ subtended by the center axis line I of that certain injection hole and the center axis line H of the nozzle is made an acute angle, and the angles $\beta$ subtended by the center axis line J of the other injection holes and the center axis line H of the nozzle, respectively, are set at substantially 90 degrees.

DESCRIPTION OF THE PREFERRED EMBODIMENTS

A detailed description is now given of a first method and device for washing drain pipe according to the present invention.

Figure 1:
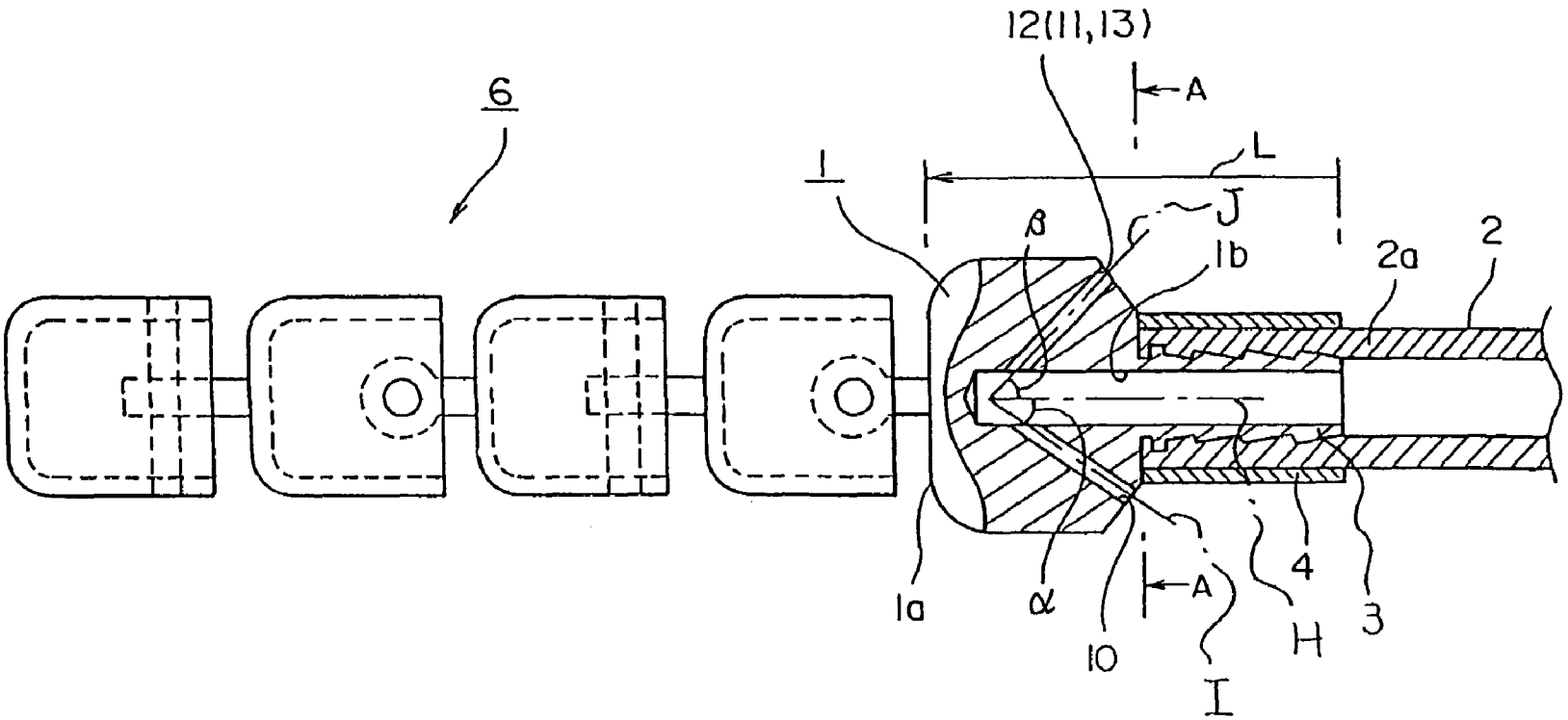
FIG. 1 is a cutaway cross-sectional view of main parts representing a nozzle relating to a first method and device for washing drain pipe of the present invention.

FIG. 1 is a cutaway cross-sectional view of main parts in the leading end part of a high pressure hose representing a nozzle 1 used in the first method and device for washing drain pipe according to the present invention.

This nozzle 1 is linked directly by means of a pressure connection socket 4 to the leading end of a high pressure hose 2 made of a rigid tube exhibiting slight flexibility, such as a stainless steel hose, for supplying high pressure water. On the leading end of this nozzle 1, moreover, is linked a commonly known universal guide 6. For the details of this universal guide 6, please refer to Japanese Patent Application Laid-Open No. S62-163789 submitted earlier by the applicant.

When the nozzle 1 and high pressure hose 2 are directly linked by the pressure connection socket 4 as described above, it is possible to make the length L between the linking end 2*a* of the high pressure hose 2 and the leading end surface 1*a* of the nozzle 1 short, wherefore the bendability of the high pressure hose 2 in bends in the pipe, described subsequently, can be sharply improved.

Figure 2:
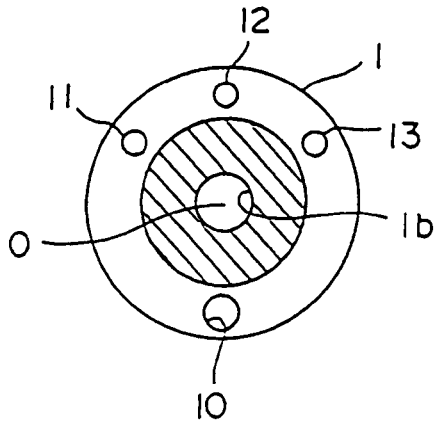
FIG. 2 is the A-A section from FIG. 1.

Meanwhile, as diagrammed in FIG. 2 which represents the A-A section from FIG. 1, four injection holes 10, 11, 12, and 13 for jetting high pressure water such as cold water or hot water are opened in the peripheral surface at the back of the nozzle 1. As diagrammed in FIG. 1, these injection holes are linked to the interior of the hose 2 by an axis hole 1*b* in the nozzle 1 and hose joint 3.

Of these injection holes 10, 11, 12, and 13, in this embodiment, the diameter of the injection hole 10 positioned at the bottom as diagrammed in FIG. 2 is made larger than the diameters of the other injection holes 11, 12, and 13 (which have the same diameter), whereby a large flow volume of high pressure water will be jetted from the injection hole 10.

Also, of the other injection holes 11, 12, and 13, the injection hole 12 is formed symmetrically with the injection hole 10, centered on the center O of the nozzle 1, and the injection holes 11 and 13 are formed at positions that are left-right symmetrical relative to a line segment connecting the injection hole 12 and the center O, such that they are inclined at prescribed angles in mutually opposite directions along the circumferential direction centered on O.

The sum of the cross-sectional areas of these injection holes 10, 11, 12, and 13 is established to be identical with the sum of the cross-sectional areas of the plurality of injection holes formed in a conventional nozzle.

Also, as diagrammed in FIG. 1, the angle of inclination of the center axis line I of the injection hole 10 having the large diameter described above is set to the angle $\alpha$ relative to the center axis line H of the axis hole 1*b* in the nozzle 1, while the angles of inclination of the center axis lines J of the other injection holes 11, 12, and 13 are set respectively at the angle $\beta$ (where $\alpha<\beta$) relative to the center axis line H of the axis hole 1*b* in the nozzle 1.

Figure 3:
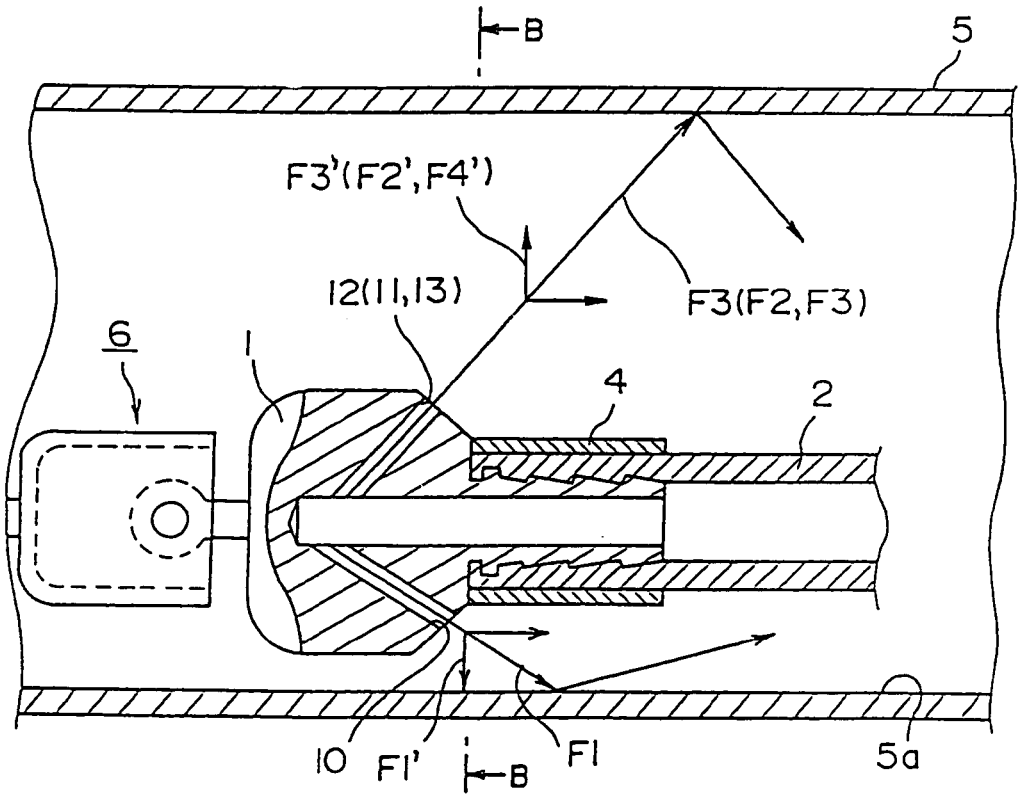
FIG. 3 is a cutaway cross-sectional view showing how a nozzle is deployed inside a lateral pipe.

The reason for setting the angle of inclination a of the injection hole 10 of large diameter smaller than the angle of inclination $\beta$ of the other injection holes 11, 12, and 13 is that, by so doing, as diagrammed in FIG. 3, in a horizontal drain pipe 5, of the jetting pressures F1, F2, F3, and F4 (where F1>F2=F3=F4) of the high pressure water jetted obliquely rearward from the injection holes 10, 11, 12, and 13, the force component F1' of the jetting pressure F1 acting toward the inner peripheral surface 5*a* of the horizontal drain pipe 5 is set to be comparatively small, the force components F2', F3', and F4' of the jetting pressures F2, F3, and F3 acting toward the inner peripheral surface 5*a* of the pipe due to F2, F3, and F4 are set to be comparatively large, and the injection hole 10 alone is pushed against the inner peripheral surface 5*a* of the pipe.

Moreover, when, in this manner, the angle of inclination $\alpha$ of the injection hole 10 is set to be small and F1' is set to be comparatively small, the force acting directly on the inner peripheral surface of the pipe is reduced, whereupon the danger of damaging the pipe during washing is reduced to the extent possible.

Figure 4:
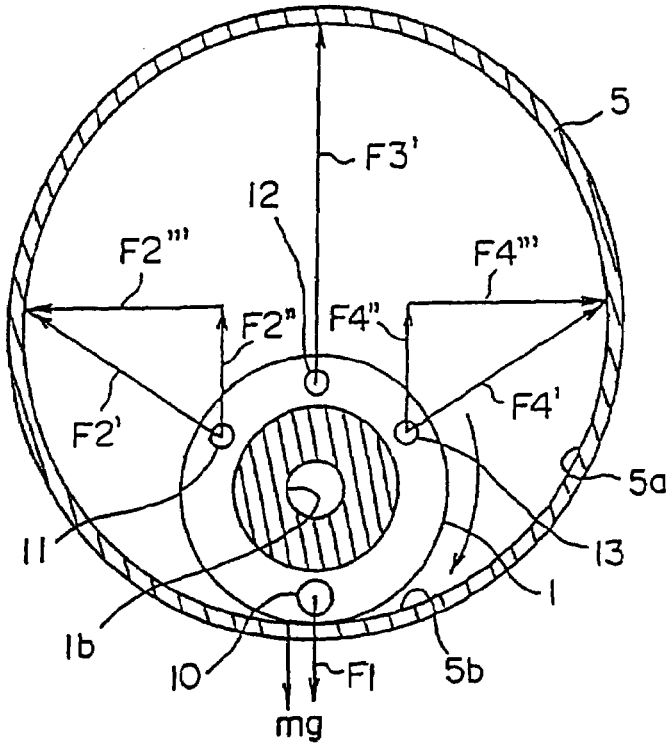
FIG. 4 is the B-B section from FIG. 3.

When high pressure water is jetted from the injection holes 10, 11, 12, and 13, respectively, having angles of inclination set in this manner, the force components F1', F2', F3', and F4', respectively, act on the inner peripheral surface 5*a* of the horizontal drain pipe 5, as diagrammed in FIG. 4, which represents the B-B section from FIG. 3.

When that is the case, reactions corresponding to F1', F2', F3', and F4' from the inner peripheral surface 5*a* of the horizontal drain pipe 5 act on the nozzle 1. However, a value mg is set so that, when the nozzle 1 is at the bottom 5*b* of the horizontal drain pipe 5, those reactions satisfy condition (1) below, namely $$F1'<F2''+F3'+F4''+\mathrm{mg}, \tag{1}$$

and so that when the nozzle 1 is at the top 5*c* of the pipe, as diagrammed in FIG. 5 where the same parts as in FIG. 4 are designated by the same symbols, those reactions satisfy condition (2) below, namely $$F1'<F2''+F3'+F4''-\mathrm{mg}, \tag{2}$$

where mg is the weight acting on the nozzle 1, F2" is the force component acting in a direction perpendicular to F2', and F4" is the force component acting in a direction perpendicular to F4'.

Figure 5:
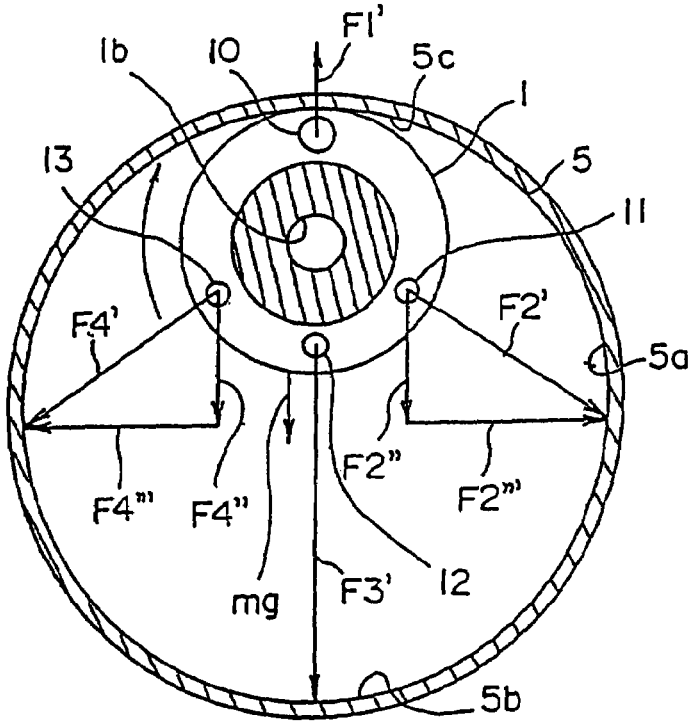
FIG. 5 is a cross-sectional view representing the operation of the first method and device for washing drain pipe of the present invention.

In FIG. 4 and FIG. 5, furthermore, F2''' is a force component acting toward the horizontal direction of F2', while F4''' is a force component acting toward the horizontal direction of F4'. The rotation of the nozzle 1 in the lateral pipe 5 is inhibited by these force components acting in these horizontal directions.

Meanwhile, when F1', F2'', F3', F4'', and mg are set (that is, when the positions where the plurality of injection holes are formed and the jetting volumes of the high pressure water jetted from those injection holes is adjusted) so that conditions (1) and (2) above are satisfied, then, as diagrammed in FIG. 4, when the nozzle 1 is at the bottom 5*b* of the lateral pipe 5, based on the setting conditions given in formula (1), the nozzle 1 will maintain an attitude wherewith only the injection hole 10 is pressed against the pipe bottom 5*b*.

When the nozzle 1 is at the top 5*c* of the lateral pipe 5, as diagrammed in FIG. 5, on the other hand, based on the setting conditions given in formula (2), the nozzle 1 maintains an attitude wherewith only the injection hole 10 is pressed against the top 5*c* of the pipe.

When the setting conditions described in the foregoing are satisfied, with the nozzle 1 attitude as diagrammed in FIG. 4, the high pressure water jetted from the injection hole 10 of largest diameter will exhibit the largest flow volume, and, in addition, that injection hole 10 will approach closest to the bottom 5*b* of the lateral pipe 5, wherefore solid material adhering to the bottom 5*b* of the lateral pipe 5 will be washed efficiently by the high pressure waterjetted from that injection hole 10.

When hot water is used for the high pressure water, the washing efficiency will be even further improved.

With the attitude of the nozzle 1 as diagrammed in FIG. 5, on the other hand, the high pressure water jetted from the injection hole 10 having the largest diameter will exhibit the largest flow volume, and also that injection hole 10 will approach closest to the top 5*c* of the lateral pipe 5, wherefore solid material adhering to the top 5*c* of the lateral pipe will be washed efficiently by the high pressure water jetted from that injection hole 10.

The drain pipe washing operation in the device for washing drain pipe described in the foregoing is described next, and the configuration thereof is described in greater detail.

Figure 6:
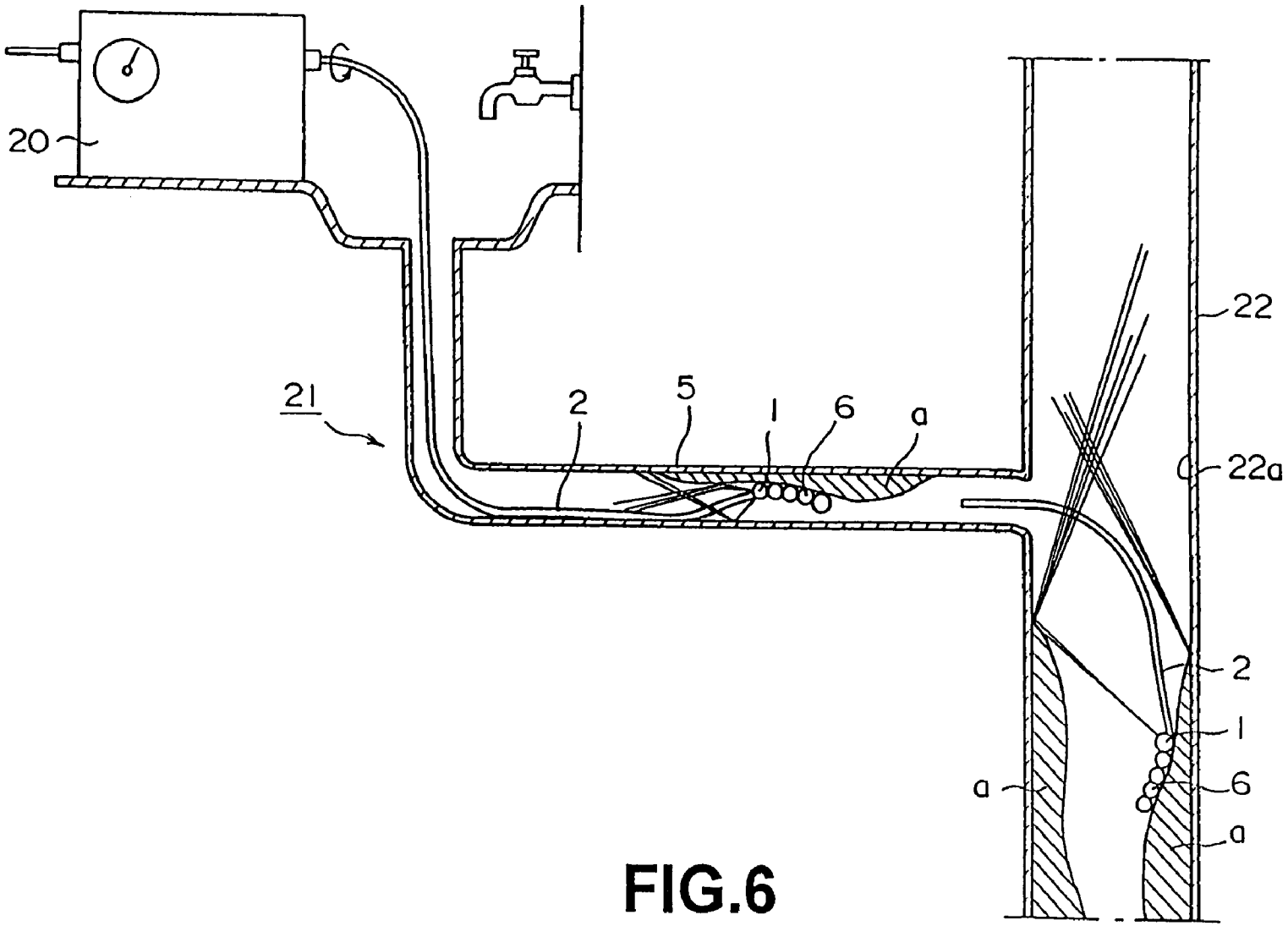
FIG. 6 is a cross-sectional view of main parts representing a drain pipe facility.
Figure 7:
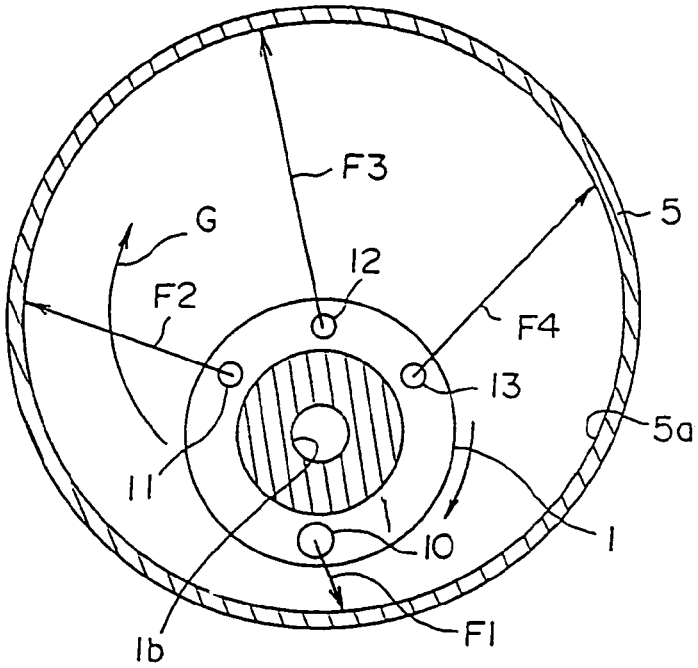
FIG. 7 is a cross-sectional view representing the operation of the first method and device for washing drain pipe of the present invention.

FIG. 6 is a cross-sectional view of main parts of a pipe facility representing the operation of the first device for washing drain pipe according to the present invention.

The high pressure hose 2 linked securely to the trailing end of the nozzle 1 is linked to the discharge port of a high pressure pump (not shown) through a terminal 20.

This terminal 20 performs control of a valve for turning the high pressure water supplied from the high pressure pump on and off, feeds out the high pressure hose 2 wound on a drum, rewinds the high pressure hose 2 onto the drum, and turns the high pressure hose 2. The details of this terminal 20 are disclosed in Japanese Utility Model Publication No. H56-36856.

The washing of a drain pipe 21 is performed by causing high pressure water placed under pressure by the high pressure pump (not shown) to be jetted from the injection holes 10, 11, 12, and 13 (cf. FIG. 2) of the nozzle 1 attached to the leading end of the high pressure hose 2.

More specifically, adhering material a is broken up and stripped away by the high pressure water jetted obliquely rearward from the nozzle 1 and, simultaneously therewith, the nozzle 1 advances along the inside of the pipe due to the propulsive force obtained by the high pressure water being jetted and to the operation of feeding out the high pressure hose 2 either by hand or automatically.

At this time, when the high pressure hose 2 is made to turn in one direction by the terminal 20, from the initial position of the nozzle 1 diagrammed in FIG. 4, inside the lateral pipe 5 of the drain pipe 21, in conjunction therewith, that nozzle 1 turns in the clockwise direction about a center that is the axis hole 1*b*, as indicated by the arrow.

When this nozzle 1 turns, the jetting directions of the high pressure water (F1, F2, F3, and F4) jetted from the injection holes 10, 11, 12, and 13 changes, and, as a consequence, a turning force will be generated in the nozzle 1 in the direction of the arrow G, while maintaining an attitude wherewith only the injection hole 10 is pressed against the inner peripheral surface 5*a* of the pipe.

Figure 8:
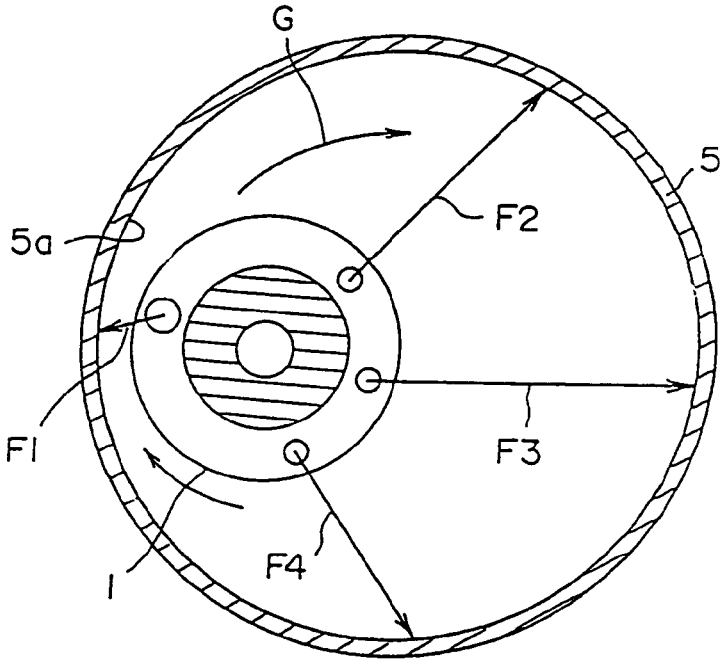
FIG. 8 is a cross-sectional view representing the operation of the first method and device for washing drain pipe of the present invention.

Thus, when the turning force is generated in the nozzle 1 in the direction of the arrow G while maintaining the attitude wherewith only the injection hole 10 is pressed against the inner peripheral surface 5*a* of the pipe, that nozzle 1 will turn inside the lateral pipe 5 while maintaining the attitude wherewith the injection hole 10 is always facing the inner peripheral surface 5*a* of the pipe, as diagrammed in FIG. 8, and the nozzle 1 will eventually arrive at a position where the injection hole 10 will face the top 5*c* of the lateral pipe 5, as diagrammed in FIG. 5.

Furthermore, when the injection hole 10 of the nozzle 1 reaches a position where it faces the top 5*c* of the lateral pipe 5, as diagrammed in FIG. 5, if the turning of the high pressure hose 2 diagrammed in FIG. 6 is stopped, the nozzle 10 will stop turning while maintaining the attitude wherewith that injection hole 10 is facing the top 5*c* of the lateral pipe 5.

Accordingly, if the turning is stopped with the attitude maintained with the injection hole 10 of the nozzle 1 facing the top 5*c* of the lateral pipe 5, as diagrammed in FIG. 5, and thereafter the high pressure hose 2 is extracted, either by hand or automatically, the nozzle 1 will advance along the longitudinal direction with the injection hole 10 thereof still facing only the top 5*c* of the lateral pipe 5, as a result of which it will be possible to break up and strip away only the adhering material a (cf. FIG. 6) inside the pipe, adhering to the top 5*c* of the lateral pipe 5, with the high pressure water having the largest flow volume jetted from the injection hole 10.

Figure 9:
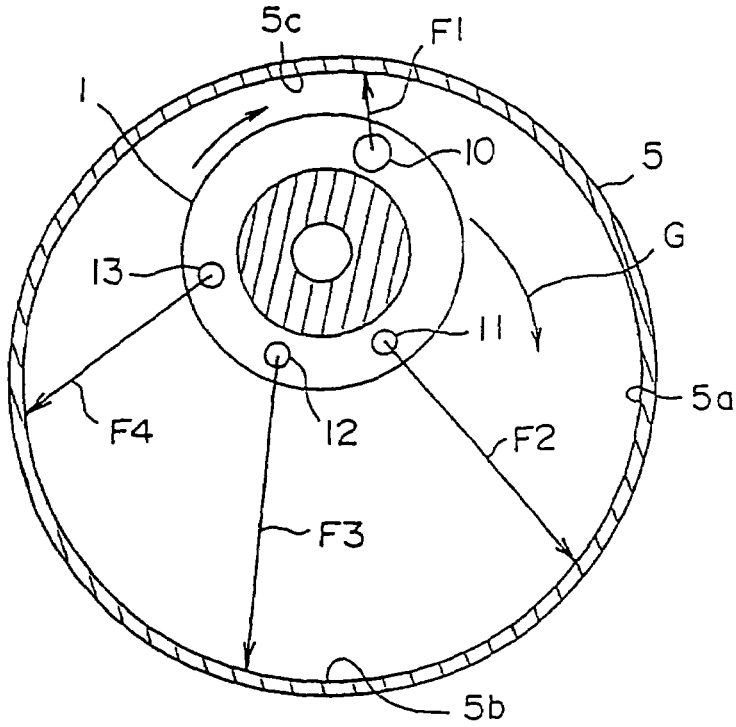
FIG. 9 is a cross-sectional view representing the operation of the first method and device for washing drain pipe of the present invention.
Figure 10:
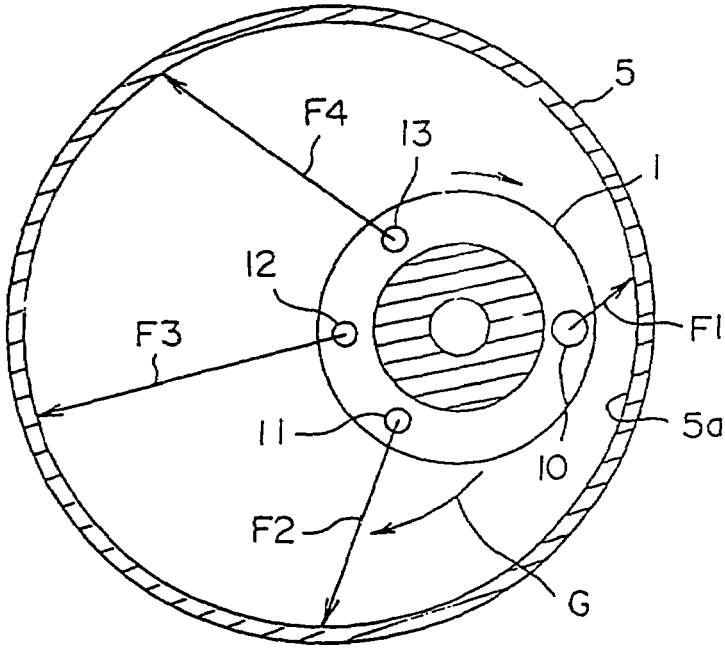
FIG. 10 is a cross-sectional view representing the operation of the first method and device for washing drain pipe of the present invention.

Furthermore, when the nozzle 1 is caused to turn further in the clockwise direction about a center that is the axis hole 1*b*, as indicated by the arrow, by causing the high pressure hose 2 to turn with the terminal 20 (cf FIG. 6), from the position of the nozzle 1 diagrammed in FIG. 5, the jetting directions of the high pressure water (F1, F2, F3, and F4) jetted from the injection holes 10, 11, 12, and 13 during that turning will again change, as diagrammed in FIG. 9, and turning will be started thereby, in the nozzle 1, in the direction of the arrow G, while maintaining an attitude wherewith only the injection hole 10 is pressed against the inner peripheral surface 5*a* of the pipe.

Thus, when turning is started, in the nozzle 1, in the direction of the arrow G, while maintaining an attitude wherewith only the injection hole 10 is pressed against the inner peripheral surface 5*a* of the pipe, that nozzle 1 will turn inside the lateral pipe 5 while maintaining the attitude wherewith the injection hole 10 continually faces the inner peripheral surface 5*a* of the pipe, and the nozzle 1 will eventually return to the initial position where the injection hole 10 faces the bottom 5*b* of the lateral pipe 5.

Figure 11:
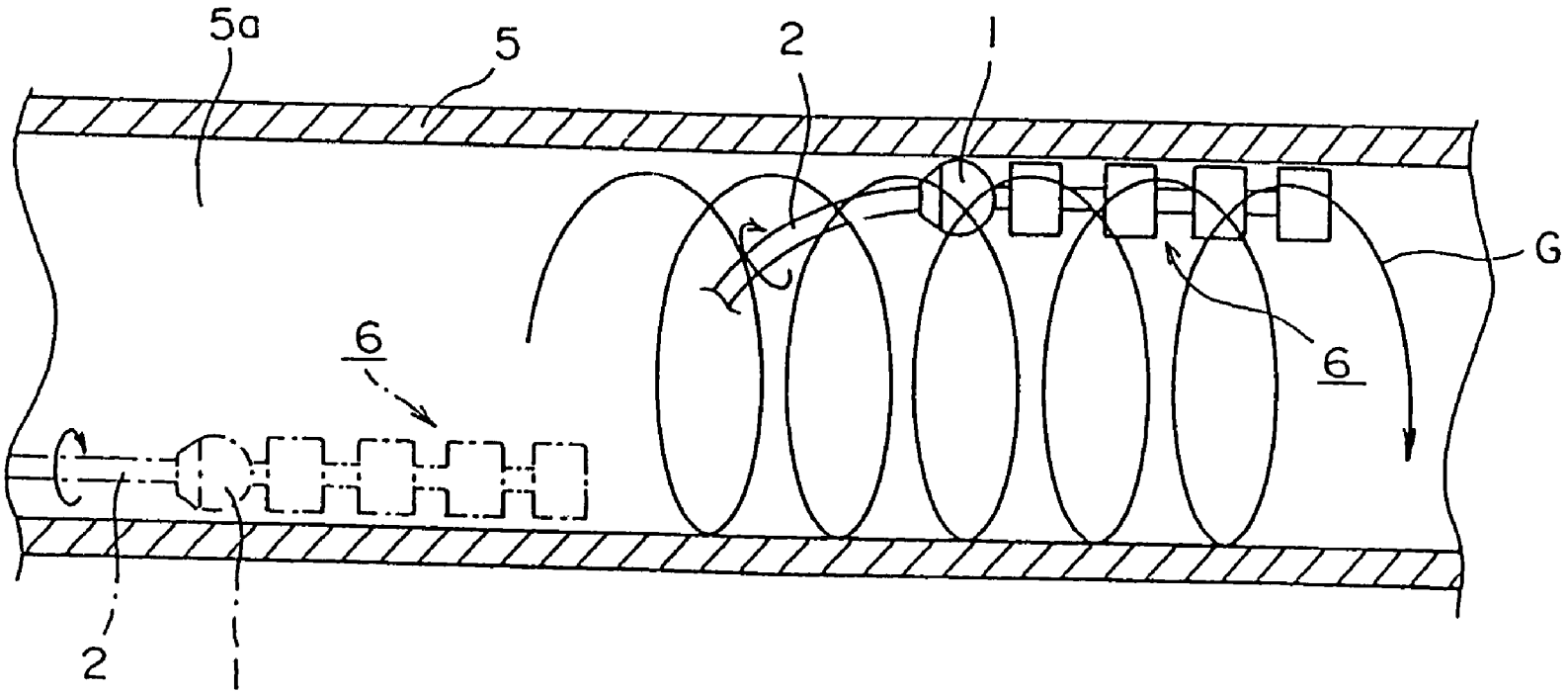
FIG. 11 is a cutaway cross-sectional view of main parts representing the operation of a nozzle in a lateral pipe.

Accordingly, inside the lateral pipe 5 in the drain pipe 21 diagrammed in FIG. 6, as diagrammed in the enlarged diagram of main parts given in FIG. 11, the high pressure hose 2 is turned by the terminal 20, and extracted, whereby that nozzle 1 is turned in a spiral manner in the direction of the arrow G while maintaining an attitude wherewith the injection hole 10 is made to face the inner peripheral surface 5*a* of the pipe, and thereby material adhering inside the pipe that is adhering to the inner peripheral surface 5*a* of the lateral pipe 5 is efficiently broken up and stripped away by the high pressure water that is jetted with the largest flow volume.

In the vertical main pipe 22 diagrammed in FIG. 6, moreover, by turning the high pressure hose 2 at a constant speed, and extracting the high pressure hose 2, the nozzle 1 turns in a spiral manner over the inner peripheral surface of the pipe.

At such time also, turning is done in a spiral manner while maintaining an attitude wherewith the injection hole 10 having the largest injection volume is made to face the inner peripheral surface 22*a* of the vertical main pipe 22, wherefore, inside the vertical pipe also, the nozzle 1 will efficiently break up and strip away the adhering material a inside the pipe.

Figure 12:
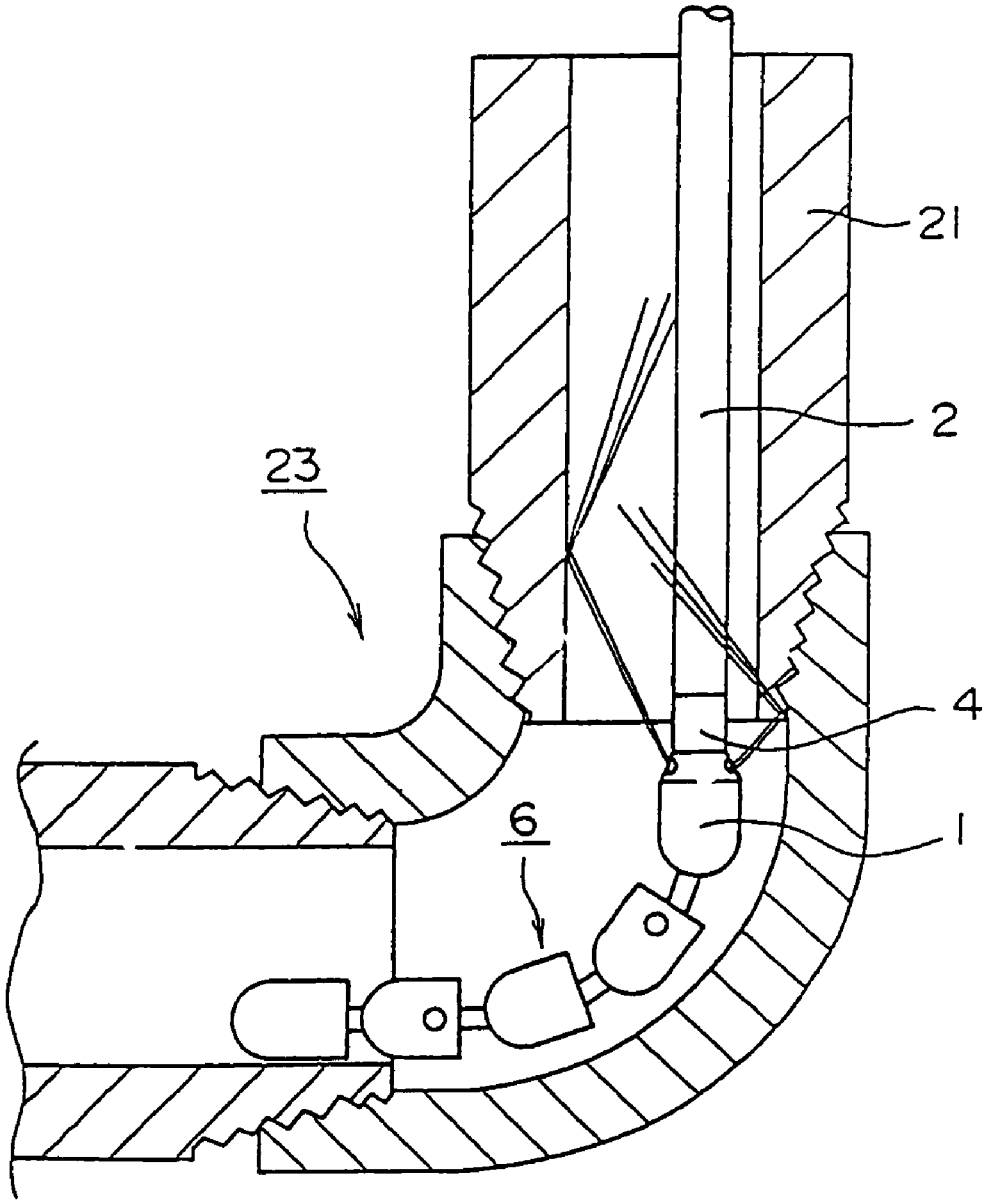
FIG. 12 is a cutaway cross-sectional view of main parts representing the operation of a nozzle in a bend in a drain pipe.

Also, as diagrammed in FIG. 1, the nozzle 1 and high pressure hose 2 are directly linked by the pressure connection socket 4, and thereby the length L between the linking end 2*a* of the high pressure hose 2 and the leading end surface 1*a* of the nozzle 1 is made short, wherefore, as diagrammed in FIG. 12, at a bend 23 in the drain pipe 21, the bendability of the high pressure hose 2 near the nozzle 1 can be improved, that is, the radius of curvature when bending can be made even smaller. Thus the nozzle 1 can pass smoothly through a bend in a drain pipe of small diameter, and can efficiently wash the bend 23 in a drain pipe of such small diameter.

Figure 13:
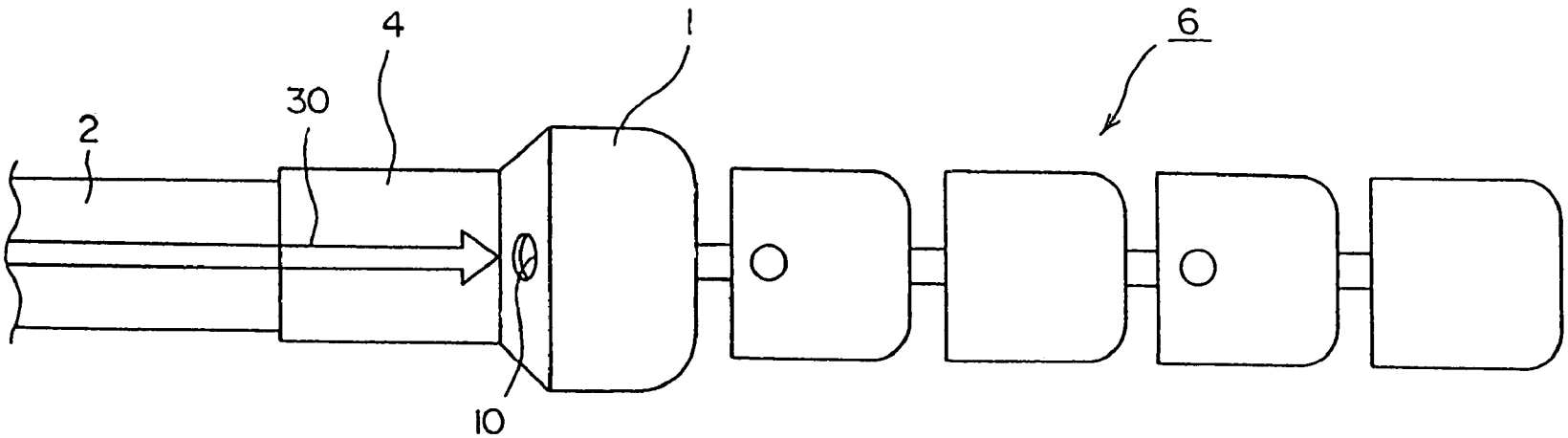
FIG. 13 is a plan of a high pressure hose representing a reference line indicating the position of a certain injection hole.

In the embodiment described in the foregoing, furthermore, an attitude can be maintained wherewith the injection hole 10 having the greatest injection volume is always made to face the inner peripheral surface of the drain pipe. Therefor, as diagrammed in FIG. 13, for example, a reference line 30 indicating the position of the injection hole 10 is formed on the peripheral surface of the high pressure hose, along the longitudinal direction thereof, at a portion thereof corresponding to the injection hole 10 in the nozzle 1, thus making it possible to definitely know at which position on the inner peripheral surface of the pipe is positioned the injection hole 10 when turning the high pressure hose 2.

For this reason, when carefully washing only the top of a drain pipe, for example, it becomes possible, by the reference line 30, to stop the turning of the high pressure hose 2 at a turning position where the position of the injection hole 10 reaches the top of the pipe, after which, if the high pressure hose 2 is extracted, it is possible to carefully wash only the top of the drain pipe.

In the embodiment described in the foregoing, moreover, a detailed description is given for a case where four injection holes 10, 11, 12, and 13 are opened in the nozzle 1 for jetting high pressure water. However, so long as the formulas (1) and (2) given above are satisfied, neither the number of injection holes, nor the positions where they are formed, nor the sizes of the diameters thereof, etc., are limited to or by the embodiment, and various modifications are possible.

In the embodiment described above, furthermore, a detailed description is given for a case where a fluid such as cold water or hot water is used as the jetting medium that is jetted from the injection holes 10, 11, 12, and 13 of the nozzle 1, but the present invention is not limited to or by that embodiment, and a mixture of a fluid and a gas may be used as the jetting medium.

Thus, by using a mixture of a fluid and a gas for the jetting medium, when the jetting medium impacts the drain pipe, the gas mixed therein can blast out and further enhance the washing force thereof.

Various materials can be used for the fluid and gas making up the jetting medium, moreover. Cold water or hot water can be used for the fluid, for example, and air can be used for the gas.

As described in the foregoing, with the first method and device for washing drain pipe of the present invention, provision is made so that the nozzle is turned in a spiral manner along the inner peripheral surface of the pipe so that, of the plurality of injection holes formed in the nozzle, a specific injection hole is always facing the inner peripheral surface of the pipe. Therefore, by the turning of the nozzle, adhering material sticking fast to all portions of the walls of the pipe can be broken up by the high pressure water jetted from the nozzle. Thus various types of pipe interiors can be completely and efficiently washed, irrespective of whether the pipe is vertical or horizontal.

Also, and particularly, the diameter of a certain injection hole is made larger than the diameters of the other injection holes, and the angle $\alpha$ subtended between the center axis line I of that certain injection hole and the center axis line H of the nozzle is made smaller than the angle $\beta$ subtended between the center axis line J of the other injection holes and the center axis line H of the nozzle ($\alpha<\beta$), wherefore the diameter of the certain injection hole that plays the washing role is made large, whereby the volume of the jetting water that breaks up the adhering material on the pipe walls can be made large, and the washing ability thereof sharply enhanced.

Also, by making the angle $\alpha$ subtended between the center axis line I of the certain injection hole that plays the washing role and the center axis line H of the nozzle small, the force acting directly on the pipe wall that is the subject of washing can be reduced, and the danger of damaging the pipe during washing can be reduced to the extent possible.

Also, by making the angle $\alpha$ subtended between the center axis line I of the certain injection hole and the center axis line H of the nozzle smaller, the diameter of the certain injection hole can be made all the more larger than the diameter of the other injection holes, and the volume of washing water jetted from that certain injection hole can be made that much larger. As a consequence, by that same measure, the high pressure hose diameter can be made narrower (smaller), and the terminal that unwinds and rewinds the high pressure hose can be made even smaller and lighter in weight.

By making the diameter of the high pressure hose narrow, moreover, passage through narrow drain pipe bends is made easy, and, in addition to making the terminal smaller as noted above, the operability of the washing device is sharply improved.

By making the high pressure hose narrower without reducing the washing ability, the pressure generating apparatus that delivers the washing liquid under pressure can also be made small, wherefore the overall washing machinery can be made smaller and lighter, and the manufacturing costs thereof can be sharply reduced.

Furthermore, when the washing machinery overall is made smaller and lighter, and the operability thereof is improved, it becomes easy even for a senior person to handle such equipment, and stable job opportunities can be afforded to seniors who face especially strict hiring conditions.

When a senior person engages in such washing work as this, furthermore, his or her wealth of knowledge and experience can be used to make the quality of the washing work even better, resulting in an overall higher level of washing work.

Also, by reducing the size and weight of the washing machinery described in the foregoing, reducing the manufacturing costs thereof, and hiring senior persons to do the washing work, the price of the drain pipe washing services offered to customers can be sharply reduced.

Next, a detailed description is given of a second method and device for washing drain pipe according to the present invention.

Figure 14:
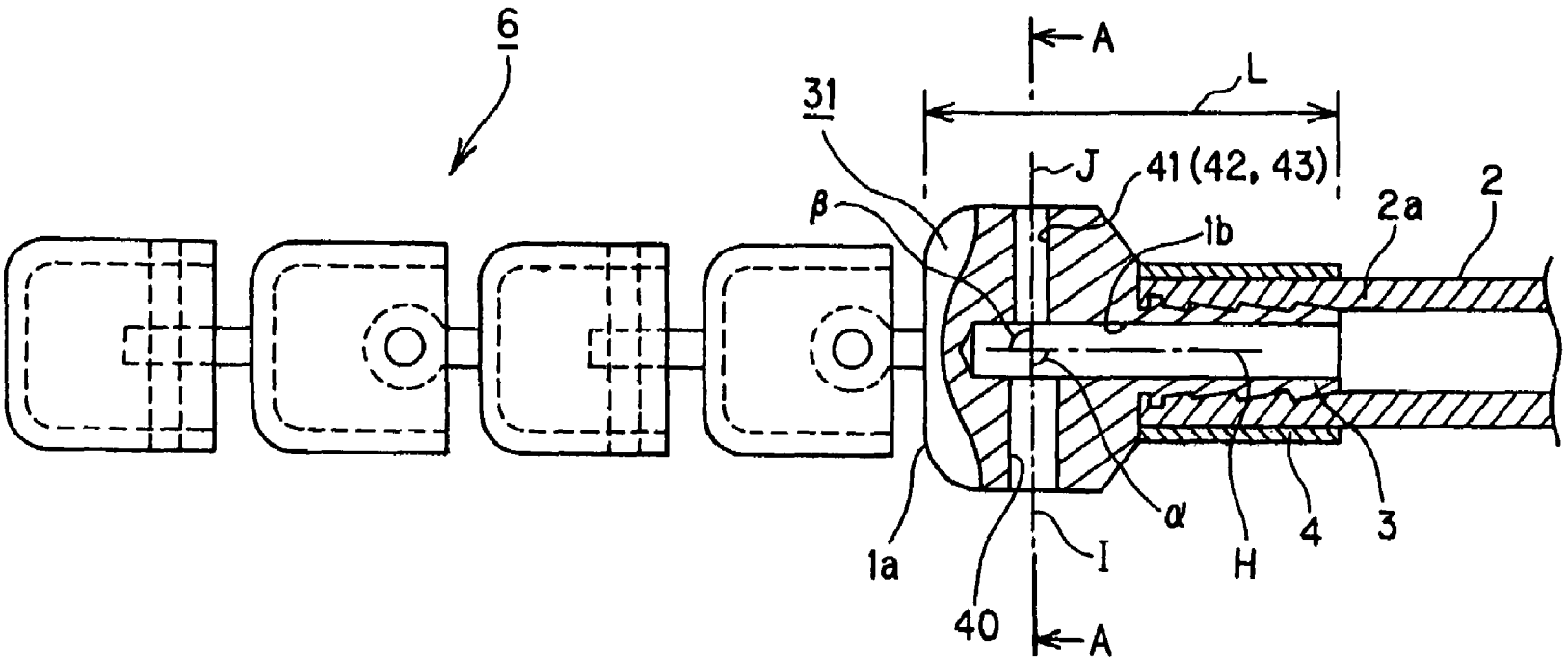
FIG. 14 is a cutaway cross-sectional view representing a nozzle relating to a second method and device for washing drain pipe of the present invention.

FIG. 14 is a cutaway cross-sectional view of main parts of a high pressure hose leading end, wherein is represented a nozzle 31 used in the second method and device for washing drain pipe according to the present invention. Parts that are identical to those in FIG. 1 to 13 are indicated by the same symbols.

This nozzle 31 is linked directly by means of a pressure connection socket 4 to the leading end of a high pressure hose 2 made of a rigid tube exhibiting slight flexibility, such as a stainless steel hose, for supplying high pressure water. On the leading end of this nozzle 31, moreover, is linked a common known universal guide 6. For the details of this universal guide 6, please refer to Japanese Patent Application Laid-Open No. S62-163789 submitted earlier by the applicant.

When the nozzle 31 and high pressure hose 2 are directly linked by the pressure connection socket 4 as described above, it is possible to make the length L between the linking end 2*a* of the high pressure hose 2 and the leading end surface 1*a* of the nozzle 31 short, wherefore the bendability of the high pressure hose 2 in bends in drain pipes can be sharply improved.

Figure 15:
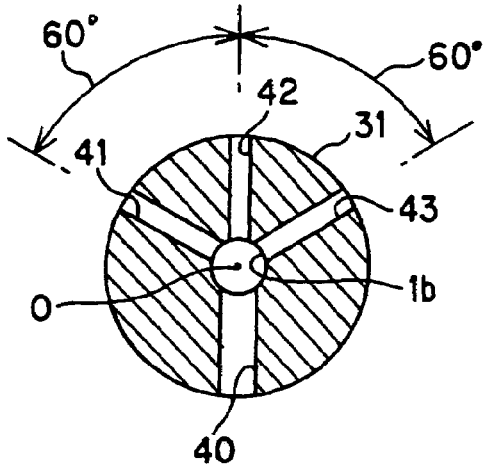
FIG. 15 is the A-A section from FIG. 27.

Meanwhile, as diagrammed in FIG. 15 which represents the A-A section from FIG. 14, four injection holes 40, 41, 42, and 43 for jetting high pressure water such as cold water or hot water are opened in the peripheral surface at the back of the nozzle 31. As diagrammed in FIG. 14, these injection holes are linked to the interior of the hose 2 by an axis hole 1*b* in the nozzle 31 and hose joint 3.

Of these injection holes 40, 41, 42, and 43, in this embodiment, the diameter of the injection hole 40 positioned at the bottom as diagrammed in FIG. 15 is made larger than the diameters of the other injection holes 41, 42, and 43 (which have the same diameter), whereby a large flow volume of high pressure water will be jetted from the injection hole 40.

Also, of the other injection holes 41, 42, and 43, the injection hole 42 is formed symmetrically with the injection hole 40, centered on the center O of the nozzle 31, and the injection holes 41 and 43 are formed at positions that are left-right symmetrical relative to a line segment connecting the injection hole 42 and the center O, such that they are inclined at prescribed angles in mutually opposite directions along the circumferential direction centered on 0.

The sum of the cross-sectional areas of these injection holes 40, 41, 42, and 43 is established to be identical with the sum of the cross-sectional areas of the plurality of injection holes formed in a conventional nozzle.

Also, as diagrammed in FIG. 14, the angle of inclination of the center axis line I of the injection hole 40 having the large diameter described above, relative to the center axis line H of the axis hole 1*b* in the nozzle 31, is set to $\alpha$=90 degrees, while the angles of inclination of the center axis lines J of the other injection holes 41, 42, and 43, relative to the center axis line H of the axis hole 1*b* in the nozzle 31, respectively, are similarly set to $\beta$=90 degrees.

That is, the center axis lines I and J of the injection holes 40, 41, 42, and 43 are formed so as to be perpendicular to the center axis line H of the nozzle 31.

Figure 16:
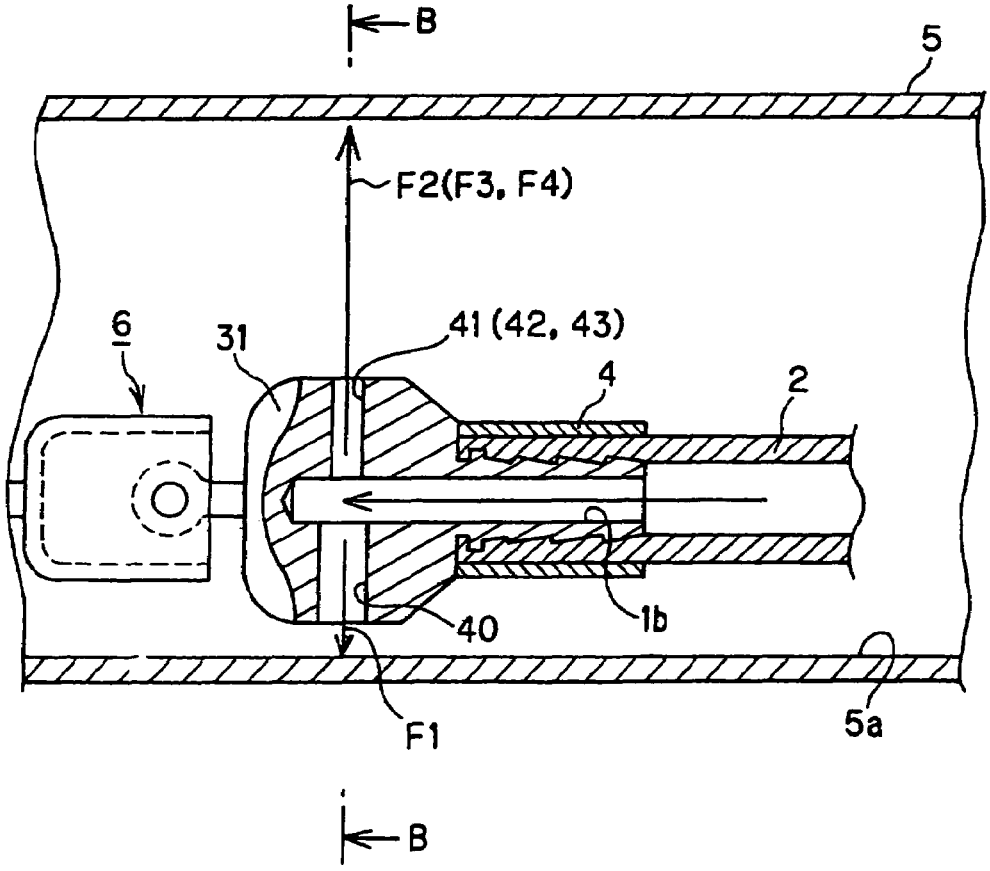
FIG. 16 is a cutaway cross-sectional view of main parts showing how a nozzle is deployed in a lateral pipe.

Moreover, when, in this manner, the angle of inclination $\alpha$ of the injection hole 40 having the large diameter and the angles of inclination $\beta$ of the other injection holes 41, 42, and 43 are set to the same 90 degrees, and, inside a horizontal drain pipe 5, the high pressure water is jetted from the injection holes 40, 41, 42, and 43 in directions perpendicular to the center axis line H of the nozzle 31, as diagrammed in FIG. 16, the nozzle 31, due to the jetting pressures therefrom, namely F1, F2, F3, and F4 (where F1>F2=F3 F4), and to the force components (described subsequently) thereof, maintains a stopped attitude inside that horizontal drain pipe 5, in a condition wherewith only the injection hole 40 of large diameter is pressed against the inner peripheral surface 5*a* of the pipe.

Figure 17:
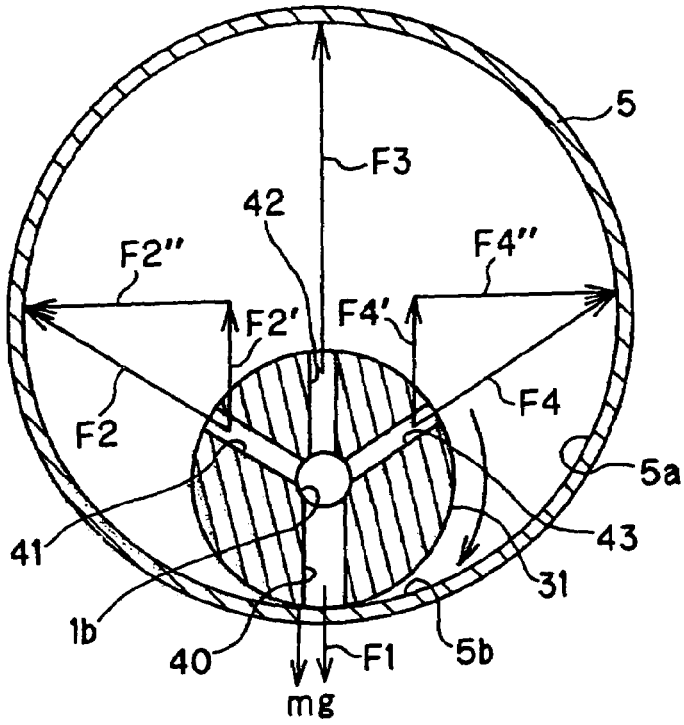
FIG. 17 is the B-B section from FIG. 16.

When, in this manner, high pressure water is jetted respectively from the injection holes 40, 41, 42, and 43 of the nozzle 31, the force components F2' and F4', respectively, will act on the inner peripheral surface 5*a* of the horizontal drain pipe 5, as diagrammed in FIG. 17 which represents the B-B section from FIG. 16.

When that is the case, reactions corresponding to F2' and F4' from the inner peripheral surface 5*a* of the horizontal drain pipe 5 act on the nozzle 31. However, a value mg is set so that, when the nozzle 31 is at the bottom 5*b* of the horizontal drain pipe 5, those reactions satisfy condition (1) below, namely $$F1<F2'+F3+F4'+mg \quad (1),$$

and so that when the nozzle 31 is at the top 5*c* of the pipe, as diagrammed in FIG. 18 where the same parts as in FIG. 17 are designated by the same symbols, those reactions satisfy condition (2) below, namely $$F1<F2'+F3+F4'-mg, \quad (2)$$

where mg is the weight acting on the nozzle 31, F2' is the force component acting in a direction perpendicular to F2, and F4' is the force component acting in a direction perpendicular to F4.

Figure 18:
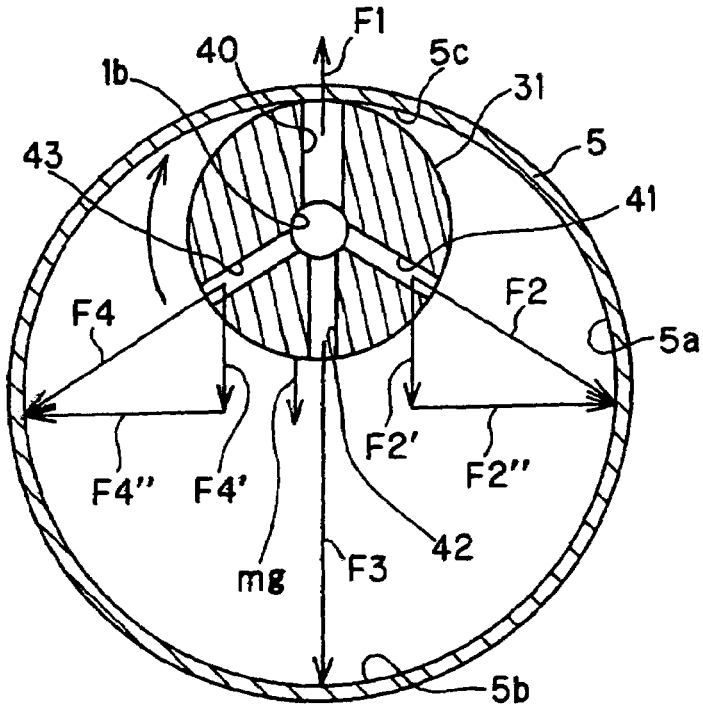
FIG. 18 is a cross-sectional view representing the operation of the second method and device for washing drain pipe of the present invention.

In FIG. 17 and FIG. 18, furthermore, F2" is a force component acting toward the horizontal direction of F2, while F4" is a force component acting toward the horizontal direction of F4. The rotation of the nozzle 31 in the lateral pipe 5 is inhibited by these force components acting in these horizontal directions.

Meanwhile, when F1, F2', F3, F4', and mg are set (that is, when the positions where the plurality of injection holes are formed and the jetting volumes of the high pressure waterjetted from those injection holes is adjusted) so that conditions (1) and (2) above are satisfied, then, as diagrammed in FIG. 17, when the nozzle 31 is at the bottom 5*b* of the lateral pipe 5, based on the setting conditions given in formula (1), the nozzle 31 will maintain an attitude wherewith only the injection hole 40 is pressed against the pipe bottom 5*b*.

When the nozzle 31 is at the top 5*c* of the lateral pipe 5, as diagrammed in FIG. 18, on the other hand, based on the setting conditions given in formula (2), the nozzle 31 maintains an attitude wherewith only the injection hole 40 is pressed against the top 5*c* of the pipe.

When the setting conditions described in the foregoing are satisfied, with the nozzle 31 attitude as diagrammed in FIG. 17, the high pressure water jetted from the injection hole 40 of largest diameter will exhibit the largest flow volume, and, in addition, that injection hole 40 will approach closest to the bottom 5*b* of the lateral pipe 5, wherefore solid material adhering to the bottom 5*b* of the lateral pipe 5 will be washed efficiently by the high pressure water jetted from that injection hole 40.

When hot water is used for the high pressure water, the washing efficiency will be even further improved.

With the attitude of the nozzle 31 as diagrammed in FIG. 18, on the other hand, the high pressure water jetted from the injection hole 40 having the largest diameter will exhibit the largest flow volume, and also that injection hole 40 will approach closest to the top 5*c* of the lateral pipe 5, wherefore solid material adhering to the top 5*c* of the lateral pipe will be washed efficiently by the high pressure water jetted from that injection hole 40.

The drain pipe washing operation in the second device for washing drain pipe described in the foregoing is described next, and the configuration thereof is described in greater detail.

Figure 19:
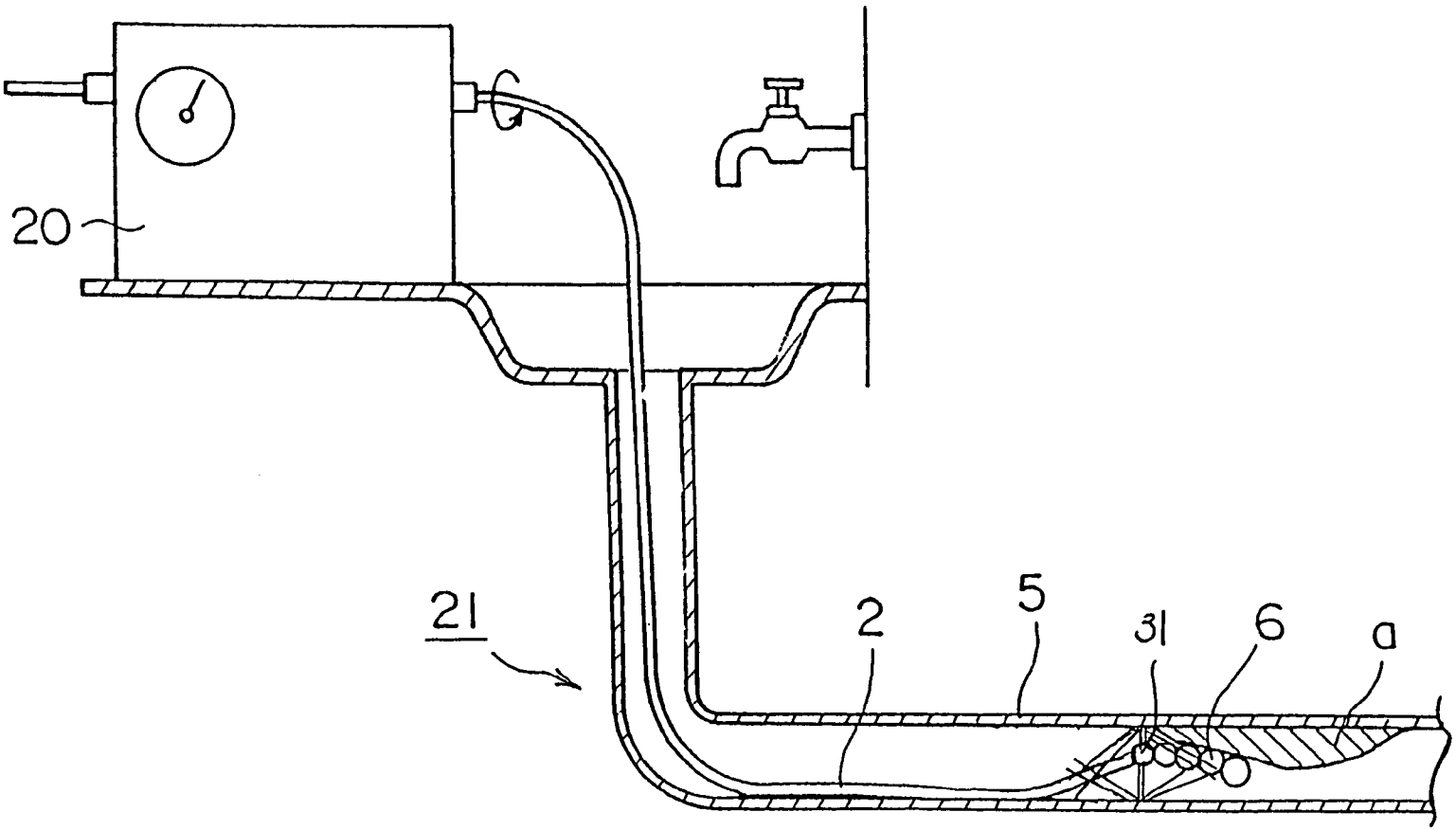
FIG. 19 is a cross-sectional view of main parts representing a drain pipe facility.

FIG. 19 is a cross-sectional view of main parts of a pipe facility representing the operation of the second device for washing drain pipe according to the present invention.

The high pressure hose 2 linked securely to the trailing end of the nozzle 31 is linked to the discharge port of a high pressure pump (not shown) through a terminal 20.

This terminal 20 performs control of a valve for turning the high pressure water supplied from the high pressure pump on and off, feeds out the high pressure hose 2 wound on a drum, rewinds the high pressure hose 2 onto the drum, and turns the high pressure hose 2. The details of this terminal 20 are disclosed in Japanese Utility Model Publication No. H56-36856.

The washing of a drain pipe 21 is performed by causing high pressure water placed under pressure by the high pressure pump (not shown) to be jetted from the injection holes 40, 41, 42, and 43 (cf. FIG. 15) of the nozzle 31 attached to the leading end of the high pressure hose 2.

More specifically, when high pressure water is jetted toward the perpendicular direction relative to the center axis line of the nozzle 31, that high pressure water strikes the pipe walls of the drain pipe 21 at right angles and breaks up and strips away the material a adhering inside the pipe. Also, because the high pressure water strikes the pipe walls of the drain pipe 21 at right angles, no propulsive force will develop in the nozzle 31 along a direction extending from the drain pipe 21, and a condition will be maintained wherein the nozzle 31 is stopped in that position.

Accordingly, the nozzle 31 described in the foregoing can be made to advance in the direction of the extension of the drain pipe 21, or to withdraw therefrom, by a manual or automatic operation on the high pressure hose 2 to extract it or pull it back.

During such an advance or withdrawal of the nozzle 31 in the lateral pipe 5 of the drain pipe 21, when the high pressure hose 2 is made to turn in one direction by the terminal 20, from the initial position of the nozzle 31 indicated in FIG. 17, in conjunction therewith that nozzle 31 will turn in a clockwise direction about the center of the axis hole 1*b*, as indicated by the arrow.

Figure 20:
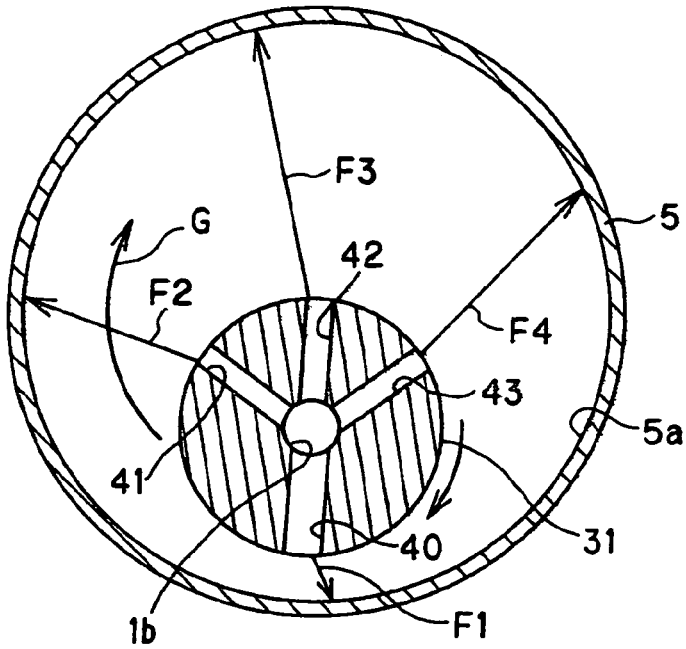
FIG. 20 is a cross-sectional view representing the operation of the second method and device for washing drain pipe of the present invention.

When this nozzle 31 turns, the jetting directions of the high pressure water (F1, F2, F3, and F4) jetted from the injection holes 40, 41, 42, and 43 change as diagrammed in FIG. 20, and, as a consequence, a turning force will be generated in the nozzle 31 in the direction of the arrow G, while maintaining an attitude wherewith only the injection hole 40 is pressed against the inner peripheral surface 5*a* of the pipe.

Figure 21:
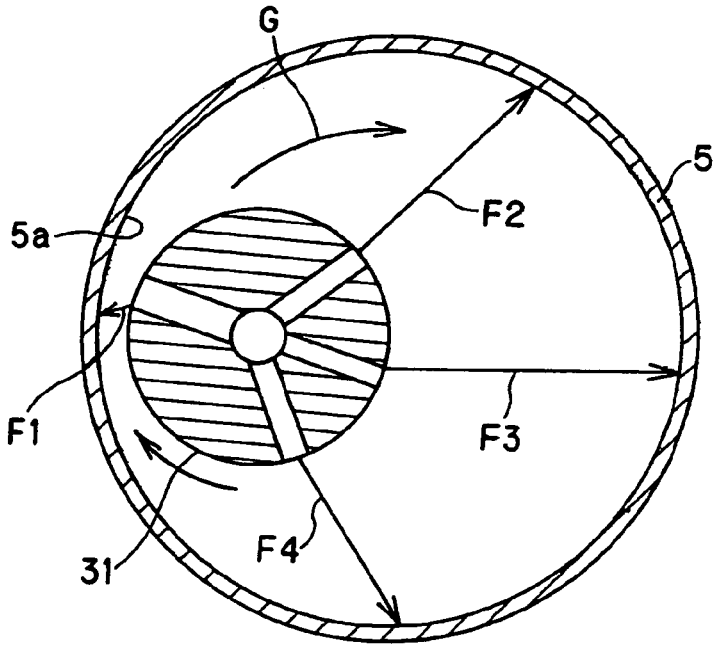
FIG. 21 is a cross-sectional view representing the operation of the second method and device for washing drain pipe of the present invention.

Thus, when the turning force is generated in the nozzle 31 in the direction of the arrow G while maintaining the attitude wherewith only the injection hole 40 is pressed against the inner peripheral surface 5*a* of the pipe, that nozzle 31 will turn inside the lateral pipe 5 while maintaining the attitude wherewith the injection hole 40 is always facing the inner peripheral surface 5*a* of the pipe, as diagrammed in FIG. 21, and the nozzle 31 will eventually arrive at a position where the injection hole 40 will face the top 5*c* of the lateral pipe 5, as diagrammed in FIG. 18.

Furthermore, at the point in time where the injection hole 40 of the nozzle 31 reaches a position where it faces the top 5*c* of the lateral pipe 5, as diagrammed in FIG. 18, if the turning of the high pressure hose 2 diagrammed in FIG. 19 is stopped, the nozzle 31 will stop turning while maintaining the attitude wherewith that injection hole 40 is facing the top 5*c* of the lateral pipe 5.

Accordingly, if the turning is stopped with the attitude maintained with the injection hole 40 of the nozzle 31 facing the top 5*c* of the lateral pipe 5, as diagrammed in FIG. 18, and thereafter the high pressure hose 2 is extracted or pulled back, either by hand or automatically, the nozzle 31 will advance or withdraw along the longitudinal direction of the pipe maintained in an attitude wherewith the injection hole 40 of the nozzle 31 faces the top 5*c* of the lateral pipe 5, as a result of which it will be possible to repeatedly wash the adhering material a (cf. FIG. 19) inside the pipe, adhering to the top 5*c* of the lateral pipe 5, with the high pressure water having the largest flow volume jetted from the injection hole 40, and thereby to break up and strip away the material a adhering inside that pipe.

That is, the nozzle 31 described in the foregoing is made so that high pressure water is jetted in a perpendicular direction relative to the center axis line thereof, and so that no propulsive force is generated in the nozzle 31 itself, wherefore the advance and retraction thereof can be performed by extracting or pulling back the high pressure hose 2, wherefore the repeated washing of a certain position in the drain pipe 21 can be done easily by the operation of extracting or pulling back the high pressure hose 2.

Figure 22:
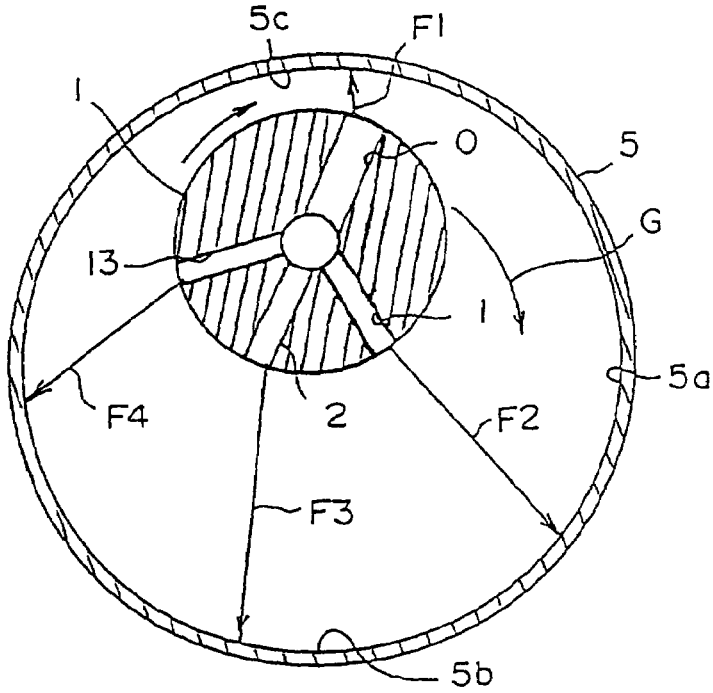
FIG. 22 is a cross-sectional view representing the operation of the second method and device for washing drain pipe of the present invention.

Furthermore, when the nozzle 31 is caused to turn further in the clockwise direction about a center that is the axis hole 1*b*, as indicated by the arrow, by causing the high pressure hose 2 to turn with the terminal 20 (cf. FIG. 19), from the position of the nozzle 31 diagrammed in FIG. 18, the jetting directions of the high pressure water (F1, F2, F3, and F4) jetted from the injection holes 40, 41, 42, and 43 during that turning will again change, as diagrammed in FIG. 22, and turning will be started thereby, in the nozzle 31, in the direction of the arrow G, while maintaining an attitude wherewith only the injection hole 40 is pressed against the inner peripheral surface 5*a* of the pipe.

Figure 23:
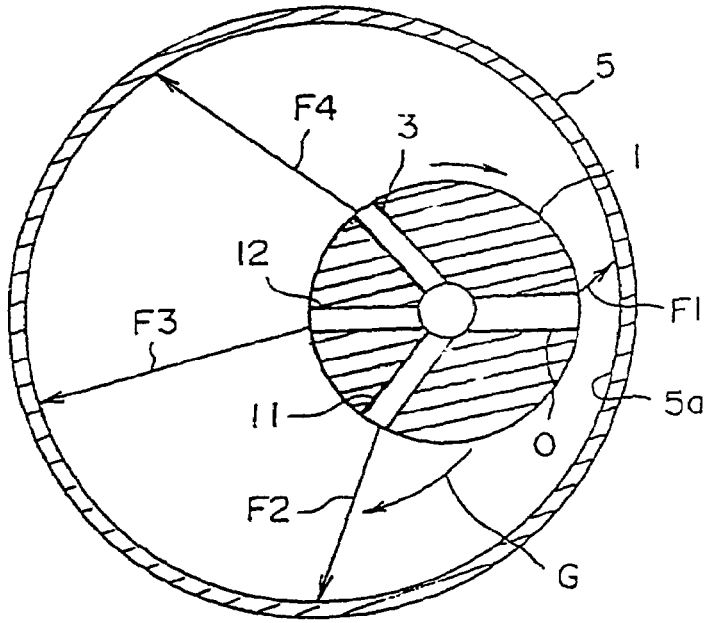
FIG. 23 is a cross-sectional view representing the operation of the second method and device for washing drain pipe of the present invention.

Thus, when turning is started, in the nozzle 31, in the direction of the arrow G, while maintaining an attitude wherewith only the injection hole 40 is pressed against the inner peripheral surface 5*a* of the pipe, that nozzle 31 will turn inside the lateral pipe 5 while maintaining the attitude wherewith the injection hole 40 continually faces the inner peripheral surface 5*a* of the pipe, as diagrammed in FIG. 23, and the nozzle 31 will eventually return to the initial position where the injection hole 40 faces the bottom 5*b* of the lateral pipe 5, as diagrammed in FIG. 17.

Figure 24:
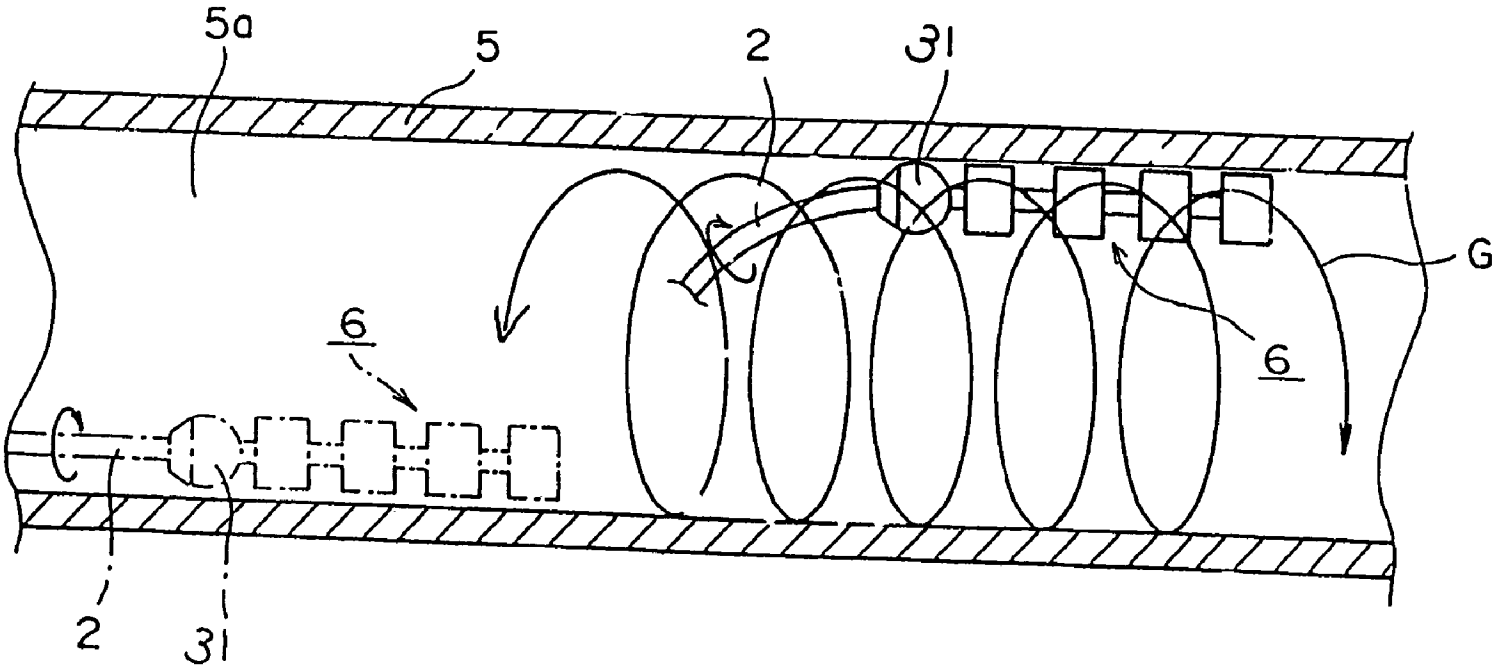
FIG. 24 is a cutaway cross-sectional view of main parts representing the operation of a nozzle in a lateral pipe.

Accordingly, inside the lateral pipe 5 in the drain pipe 21 diagrammed in FIG. 19, as diagrammed in the enlarged diagram of main parts given in FIG. 24, the high pressure hose 2 is turned by the terminal 20, and the high pressure 2 is extracted and pulled back, by which operations that nozzle 31 is turned in a spiral manner in the direction of the arrow G while maintaining an attitude wherewith the injection hole 40 is made to face the inner peripheral surface 5*a* of the pipe, and thereby adhering material inside the pipe that is adhering at a certain position on the inner peripheral surface 5*a* of the lateral pipe 5 is repeatedly washed and efficiently broken up and stripped away by the high pressure water that is jetted with the largest flow volume.

Figure 25:
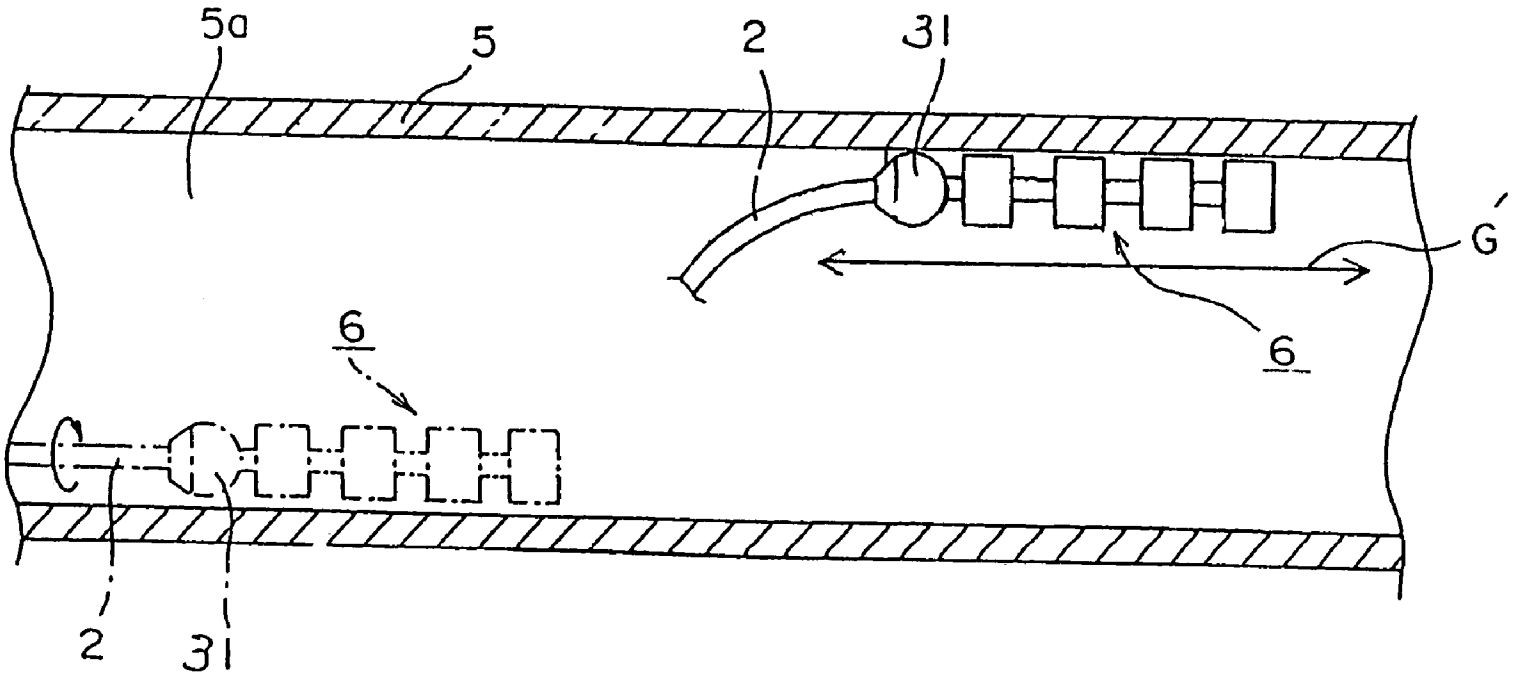
FIG. 25 is a cutaway cross-sectional view of main parts representing the operation of a nozzle in a lateral pipe.

Also, by stopping the turning of the high pressure hose 2, stopping the nozzle 31 at a certain position, and then extracting or pulling back the high pressure hose 2, as diagrammed in FIG. 25, the nozzle 31 is made to travel backwards and forwards in the direction indicated by the arrow G', while maintaining an attitude wherewith the injection hole 40, which produces the greatest injection volume, is made to face the inner peripheral surface 5*a* of the pipe. Thereby, adhering material inside the pipe that is adhering at the certain position on the inner peripheral surface 5*a* in the lateral pipe 5 can be repeatedly washed by the high pressure water that is jetted with the greatest flow volume, and efficiently broken up and stripped away.

In the vertical main pipe of the drain pipe (not shown), moreover, by turning the high pressure hose 2 at a constant speed, and extracting the high pressure hose 2, the nozzle 31 turns in a spiral manner over the inner peripheral surface of the pipe.

At such time also, turning is done in a spiral manner while maintaining an attitude wherewith the injection hole 40 having the largest injection volume is made to face the inner peripheral surface of the vertical main pipe, wherefore, inside the vertical pipe also, the nozzle 31 will efficiently break up and strip away the adhering material a inside the pipe.

In a vertical pipe also, by stopping the turning of the high pressure hose 2, stopping the nozzle 31 at a certain position, and then extracting or pulling back the high pressure hose 2, the nozzle 31 will travel backwards and forwards, while maintaining an attitude wherewith the injection hole 40, which produces the greatest injection volume, is made to face a certain position on the inner peripheral surface of the vertical pipe. Thereby, adhering material inside the pipe that is adhering at the certain position on the inner peripheral surface in the vertical pipe can be repeatedly washed by the high pressure water that is jetted with the greatest flow volume, and efficiently broken up and stripped away.

Figure 26:
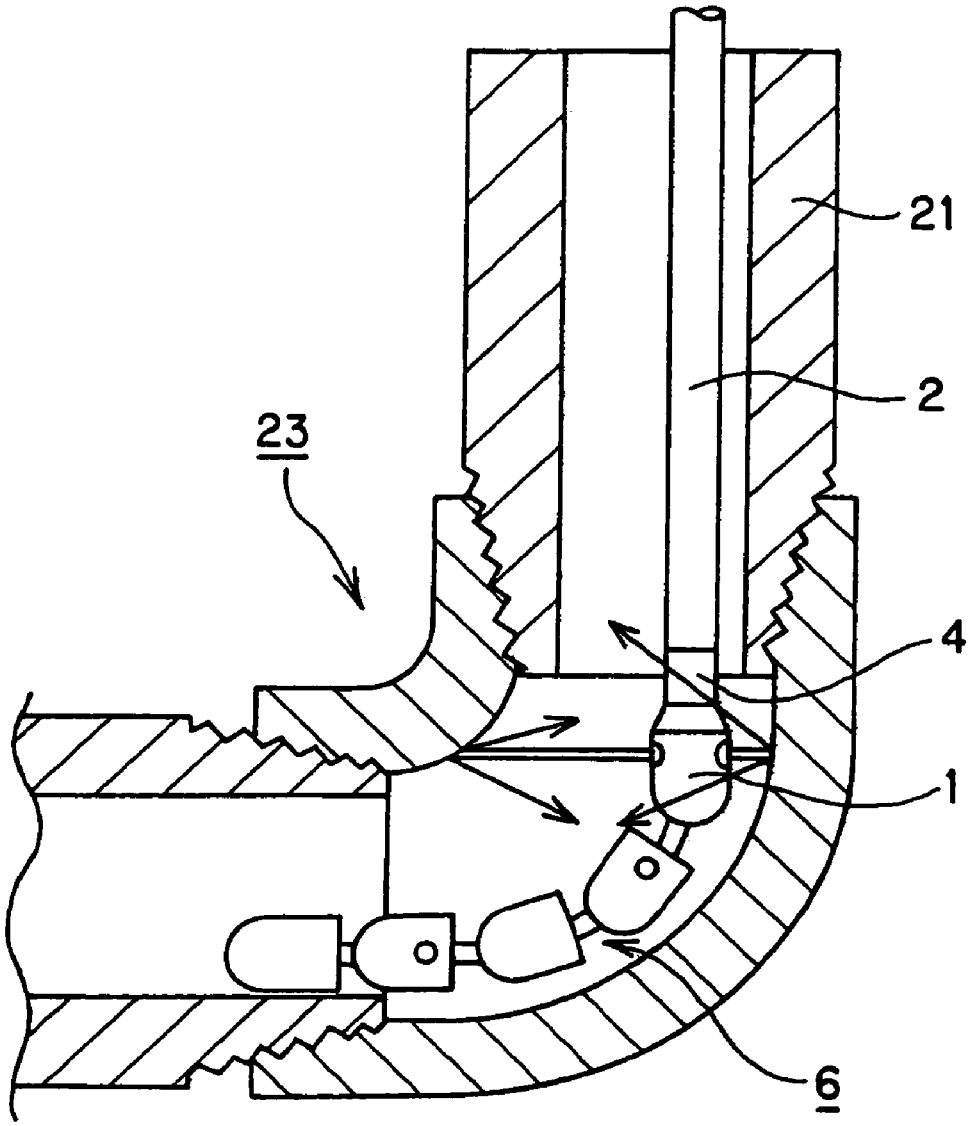
FIG. 26 is a cutaway cross-sectional view of main parts representing the operation of a nozzle in a bend in a drain pipe.

Also, as diagrammed in FIG. 14, the nozzle 31 and high pressure hose 2 are directly linked by the pressure connection socket 4, and thereby the length L between the linking end 2*a* of the high pressure hose 2 and the leading end surface 1*a* of the nozzle 31 is made short, wherefore, as diagrammed in FIG. 26, at a bend 23 in the drain pipe 21, the bendability of the high pressure hose 2 near the nozzle 31 can be improved, that is, the radius of curvature when bending can be made even smaller. Thus the nozzle 31 can pass smoothly through a bend in a drain pipe of small diameter, and can efficiently wash the bend 23 in a drain pipe of such small diameter.

Figure 27:
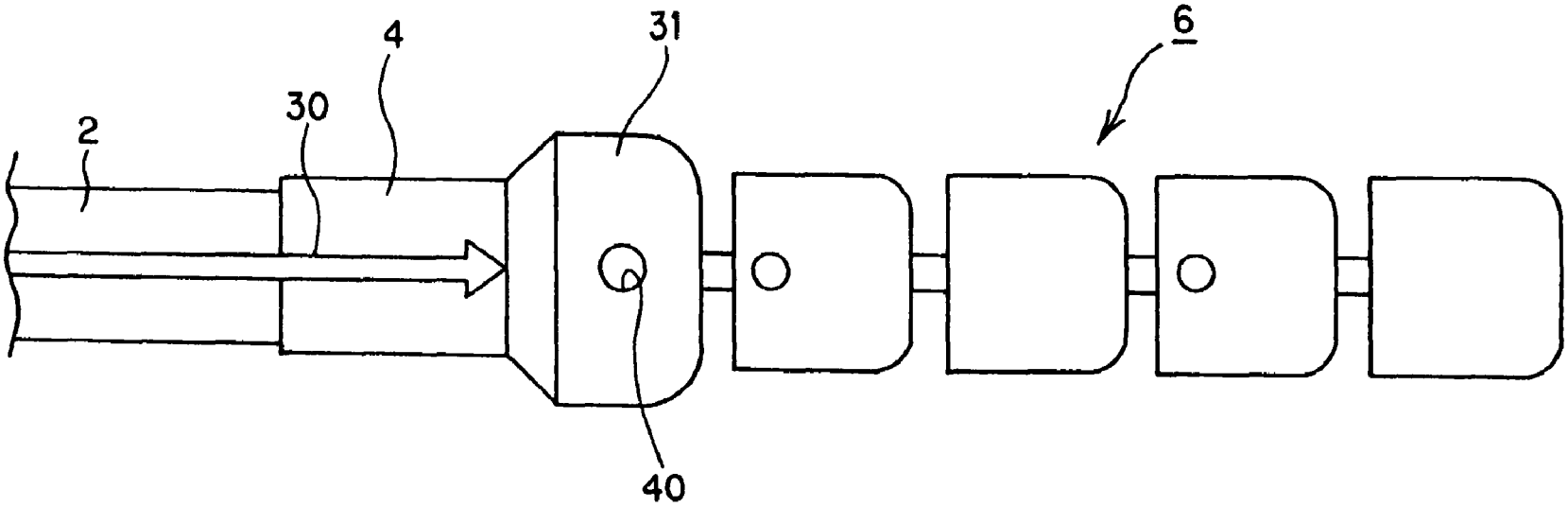
FIG. 27 is a plan of a high pressure hose representing a reference line for indicating the position of a certain injection hole.

In the embodiment described in the foregoing, furthermore, an attitude can be maintained wherewith the injection hole 40 having the greatest injection volume is always made to face the inner peripheral surface of the drain pipe. Therefor, as diagrammed in FIG. 27, for example, a reference line 30 indicating the position of the injection hole 40 is formed on the peripheral surface of the high pressure hose 2, along the longitudinal direction thereof, at a portion thereof corresponding to the injection hole 40 in the nozzle 31, thus making it possible to definitely know at which position on the inner peripheral surface of the pipe is positioned the injection hole 40 when turning the high pressure hose 2.

For this reason, when carefully washing only the top of a drain pipe, for example, it becomes possible, by the reference line 30, to stop the turning of the high pressure hose 2 at a turning position where the position of the injection hole 40 reaches the top of the pipe, after which, if the high pressure hose 2 is extracted or pulled back, it will be possible to carefully and repeatedly wash only the top of the drain pipe.

In the embodiment described in the foregoing, moreover, a detailed description is given for a case where four injection holes 40, 41, 42, and 43 are opened in the nozzle 31 for jetting high pressure water. However, so long as the formulas (1) and (2) given above are satisfied, neither the number of injection holes, the positions where they are formed, nor the sizes of the diameters thereof, etc., are limited to or by the embodiment, and various modifications are possible.

In the embodiment described above, furthermore, a detailed description is given for a case where a fluid such as water or hot water is used as the jetting medium that is jetted from the injection holes 40, 41, 42, and 43 in the nozzle 31, but the present invention is not limited to or by that embodiment, and a mixture of a fluid and a gas may be used as the jetting medium.

Thus, by using a mixture of a fluid and a gas for the jetting medium, when the jetting medium impacts the drain pipe, the gas mixed therein can blast out and further enhance the washing force thereof.

Various materials can be used for the fluid and gas making up the jetting medium, moreover. Cold water or hot water can be used for the fluid, for example, and air can be used for the gas.

As described in the foregoing, with the second method and device for washing drain pipe of the present invention, provision is made so that, in conjunction with turning, extracting, and pulling back the high pressure hose, the nozzle is made to turn in a spiral manner, so that, of the plurality of injection holes, only a certain injection hole will always face the inner peripheral surface of the pipe, and provision is made further so that the diameter of the certain injection hole is made larger than the diameters of the other injection holes, and so that the angle $\alpha$ subtended between the center axis line I of that certain injection hole and the center axis line H of the nozzle, on the one hand, and the angle $\beta$ subtended between the center axis lines J of the other injection holes and the center axis line H of the nozzle, respectively, on the other hand, are made 90 degrees. Therefore, not only is it possible, by the turning of the nozzle, to efficiently break up the adhering material sticking fast to all parts of the periphery of the pipe walls by the high pressure water jetted from the certain injection hole of large diameter, but the nozzle can also be stopped at a certain position inside the drain pipe, in an attitude wherewith the certain injection hole of large diameter is facing the inner peripheral surface of the pipe. Therefore, by the simple operation of extracting or pulling back the high pressure hose, certain positions inside various kinds of pipes, irrespective of whether they be lateral pipes or vertical pipes, can be repeatedly washed by high pressure water jetted from the certain injection hole of large diameter, and, thereby, with a simple operation, certain positions in pipes can be carefully washed.

A detailed description is given next of a third method and device for washing drain pipe according to the present invention.

Figure 28:
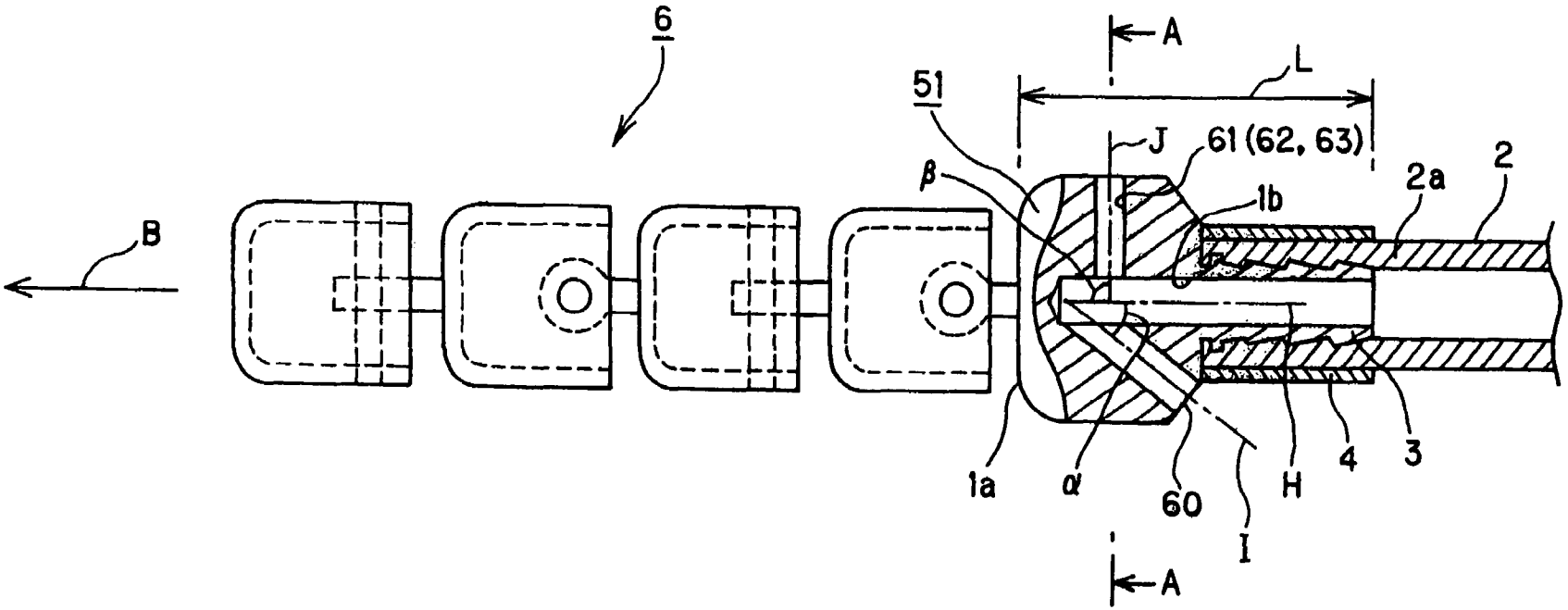
FIG. 28 is a cutaway cross-sectional view of main parts representing a nozzle relating to a third method and device for washing drain pipe of the present invention.

FIG. 28 is a cutaway cross-sectional view of main parts of a high pressure hose leading end, wherein is represented a nozzle 51 used in the third method and device for washing drain pipe according to the present invention. Parts that are identical to those in FIG. 1 to 14 are indicated by the same symbols.

This nozzle 51 is linked directly by means of a pressure connection socket 4 to the leading end of a high pressure hose 2 made of a rigid tube exhibiting slight flexibility, such as a stainless steel hose, for supplying high pressure water. On the leading end of this nozzle 51, moreover, is linked a common known universal guide 6. For the details of this universal guide 6, please refer to Japanese Patent Application Laid-Open No. S62-163789/1987 submitted earlier by the applicant.

When the nozzle 51 and high pressure hose 2 are directly linked by the pressure connection socket 4 as described above, it is possible to make the length L between the linking end 2*a* of the high pressure hose 2 and the leading end surface 1*a* of the nozzle 51 short, wherefore the bendability of the high pressure hose 2 in bends in drain pipes can be sharply improved.

Figure 29:
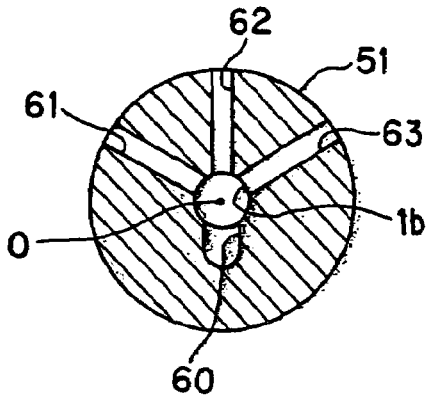
FIG. 29 is the A-A section from FIG. 41.

Meanwhile, as diagrammed in FIG. 29 which represents the A-A section from FIG. 28, four injection holes 60, 61, 62, and 63 for jetting high pressure water such as cold water or hot water are opened in the peripheral surface at the back of the nozzle 51. As diagrammed in FIG. 28, these injection holes 60, 61, 62 and 63 are linked to the interior of the hose 2 by an axis hole 1*b* in the nozzle 51 and hose joint 3.

Of these injection holes 60, 61, 62, and 63, in this embodiment, the diameter of the injection hole 60 positioned at the bottom as diagrammed in FIG. 29 is made larger than the diameters of the other injection holes 61, 62, and 63 (which have the same diameter), whereby a large flow volume of high pressure water will be jetted from the injection hole 60.

Also, of the other injection holes 61, 62, and 63, the injection hole 62 is formed symmetrically with the injection hole 60, centered on the center O of the nozzle 51, and the injection holes 61 and 63 are formed at positions that are left-right symmetrical relative to a line segment connecting the injection hole 62 and the center O.

The sum of the cross-sectional areas of these injection holes 60, 61, 62, and 63 is established to be identical with the sum of the cross-sectional areas of the plurality of injection holes formed in a conventional nozzle.

Also, as diagrammed in FIG. 28, the angle of inclination $\alpha$ of the center axis line I of the injection hole 60 having the large diameter described above, relative to the center axis line H of the axis hole 1*b* in the nozzle 51, is set at an acute angle ($0° < \alpha < 90°$), while the angles of inclination β of the center axis lines J of the other injection holes 61, 62, and 63, relative to the center axis line H of the axis hole 1*b* in the nozzle 51, respectively, are similarly made substantially 90 degrees (more or less perpendicular).

Furthermore, as diagrammed in FIG. 28, of the injection holes 60, 61, 62, and 63, described in the foregoing, the position where the injection hole 60 of large diameter is formed is made farther rearward than the positions of the other injection holes 61, 62, and 63, as seen from the direction of advance of the nozzle 51 (as indicated by arrow B).

Figure 30:
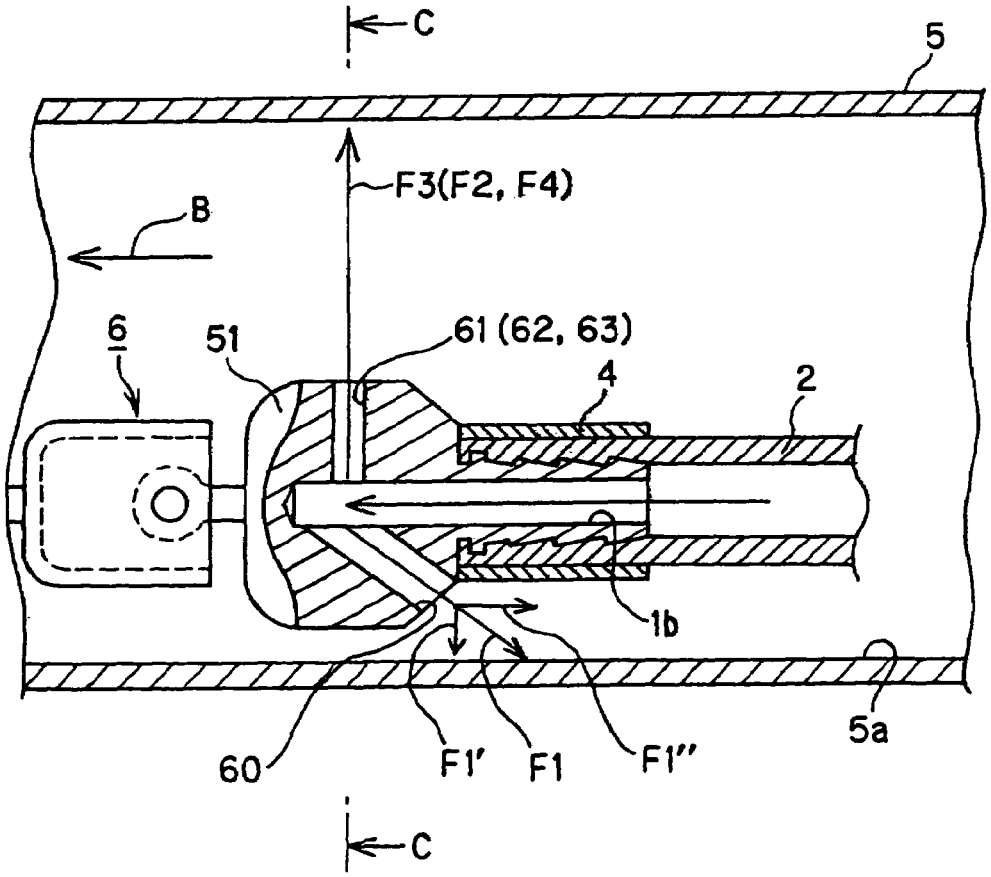
FIG. 30 is a cutaway cross-sectional view showing how a nozzle is deployed inside a lateral pipe.

When, in this manner, the angle of inclination α of the injection hole 60 of large diameter is set at an acute angle relative to the center axis line H of the axis hole 1*b* in the nozzle 51, and the angles of inclination β of the other injection holes 61, 62, and 63 are set at substantially 90 degrees, then, after inserting the nozzle 51 inside the horizontal drain pipe 5, as diagrammed in FIG. 30, and jetting high pressure water from the injection holes 60, 61, 62, and 63, the nozzle 51 is maintained at an attitude where it is stopped inside that horizontal drain pipe 5, in a condition wherein, due to the force component F1' of the force F1 acting perpendicular to the inner peripheral surface 5*a* of the horizontal drain pipe 5 and the resultant of the forces F2, F3, and F4, of the jetting pressures F1, F2, F3, and F4 (where F1>F2=F3=F4), only the injection hole 60 of large diameter is pressed against the inner peripheral surface 5*a* of the pipe. Furthermore, the force component F1" of F1 that is parallel to the inner peripheral surface 5*a* of the horizontal drain pipe 5 acts as a propulsive force on the nozzle 51 in the direction indicated by the arrow B.

Figure 31:
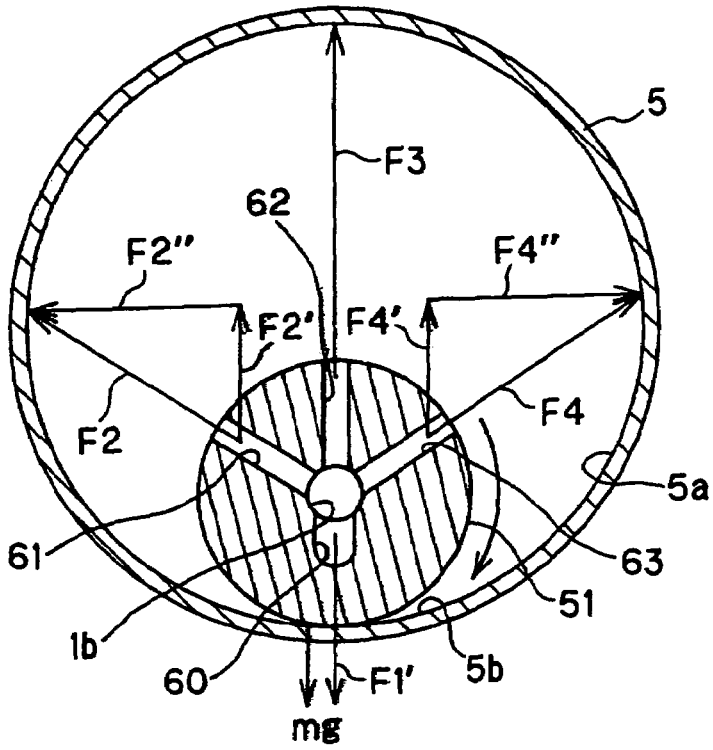
FIG. 31 is the C-C section from FIG. 30.

Thus, when high pressure water is jetted respectively from the injection holes 60, 61, 62, and 63 of the nozzle 51, the force component F1', and the force components F2', F4', and F3 oriented opposite thereto, act on the inner peripheral surface 5*a* of the horizontal drain pipe 5, as diagrammed in FIG. 31 which represents the CC section of FIG. 30.

When that is the case, reactions corresponding to F2', F3, and F4' from the inner peripheral surface 5*a* of the horizontal drain pipe 5 act on the nozzle 51. However, a value mg is set so that, when the nozzle 51 is at the bottom 5*b* of the horizontal drain pipe 5, those reactions satisfy condition (1) below, namely $$F1' < F2' + F3 + F4' + \mathrm{mg}, \tag{1}$$

and so that when the nozzle 51 is at the top 5*c* of the pipe, as diagrammed in FIG. 32 where the same parts as in FIG. 31 are designated by the same symbols, those reactions satisfy condition (2) below, namely $$F1' < F2' + F3 + F4' - \mathrm{mg}, \tag{2}$$

where mg is the weight acting on the nozzle 51, F2' is the force component acting in a direction perpendicular to F2, and F4' is the force component acting in a direction perpendicular to F4.

Figure 32:
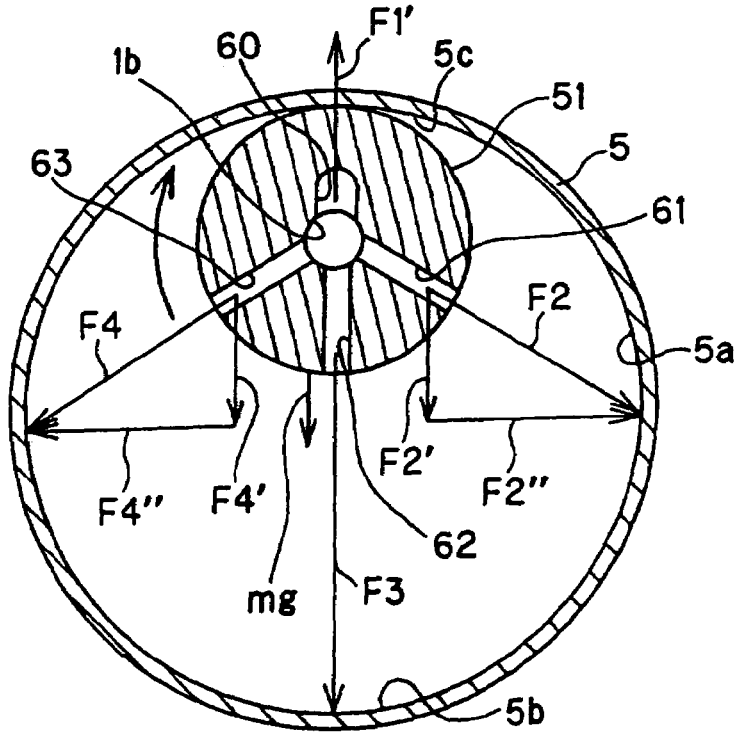
FIG. 32 is a cross-sectional view representing the operation of the third method and device for washing drain pipe of the present invention.

In FIG. 31 and FIG. 32, furthermore, F2" is a force component acting toward the horizontal direction of F2, while F4" is a force component acting toward the horizontal direction of F4. The rotation of the nozzle 51 in the lateral pipe 5 is inhibited by these force components acting in these horizontal directions.

Meanwhile, when F1', F2', F3, F4', and mg are set (that is, when the positions where the plurality of injection holes are formed and the jetting volumes of the high pressure water jetted from those injection holes is adjusted) so that conditions (1) and (2) above are satisfied, then, as diagrammed in FIG. 42, when the nozzle 51 is at the bottom 5*b* of the lateral pipe 5, based on the setting conditions given in formula (1), the nozzle 51 will maintain an attitude wherewith only the injection hole 60 is pressed against the pipe bottom 5*b*.

When the nozzle 51 is at the top 5*c* of the lateral pipe 5, as diagrammed in FIG. 32, on the other hand, based on the setting conditions given in formula (2), the nozzle 51 maintains an attitude wherewith only the injection hole 60 is pressed against the top 5*c* of the pipe.

When the setting conditions described in the foregoing are satisfied, with the nozzle 51 attitude as diagrammed in FIG. 31, the high pressure water jetted from the injection hole 60 of largest diameter will exhibit the largest flow volume, and, in addition, that injection hole 60 will approach closest to the bottom 5*b* of the lateral pipe 5, wherefore solid material adhering to the bottom 5*b* of the lateral pipe 5 will be washed efficiently by the high pressure water jetted from that injection hole 60.

When hot water is used for the high pressure water, the washing efficiency will be even further improved.

With the attitude of the nozzle 51 as diagrammed in FIG. 32, on the other hand, the high pressure waterjetted from the injection hole 60 having the largest diameter will exhibit the largest flow volume, and also that injection hole 60 will approach closest to the top 5*c* of the lateral pipe 5, wherefore solid material adhering to the top 5*c* of the lateral pipe will be washed efficiently by the high pressure water jetted from that injection hole 60.

The drain pipe washing operation in the third device for washing drain pipe described in the foregoing is described next, and the configuration thereof is described in greater detail.

Figure 33:
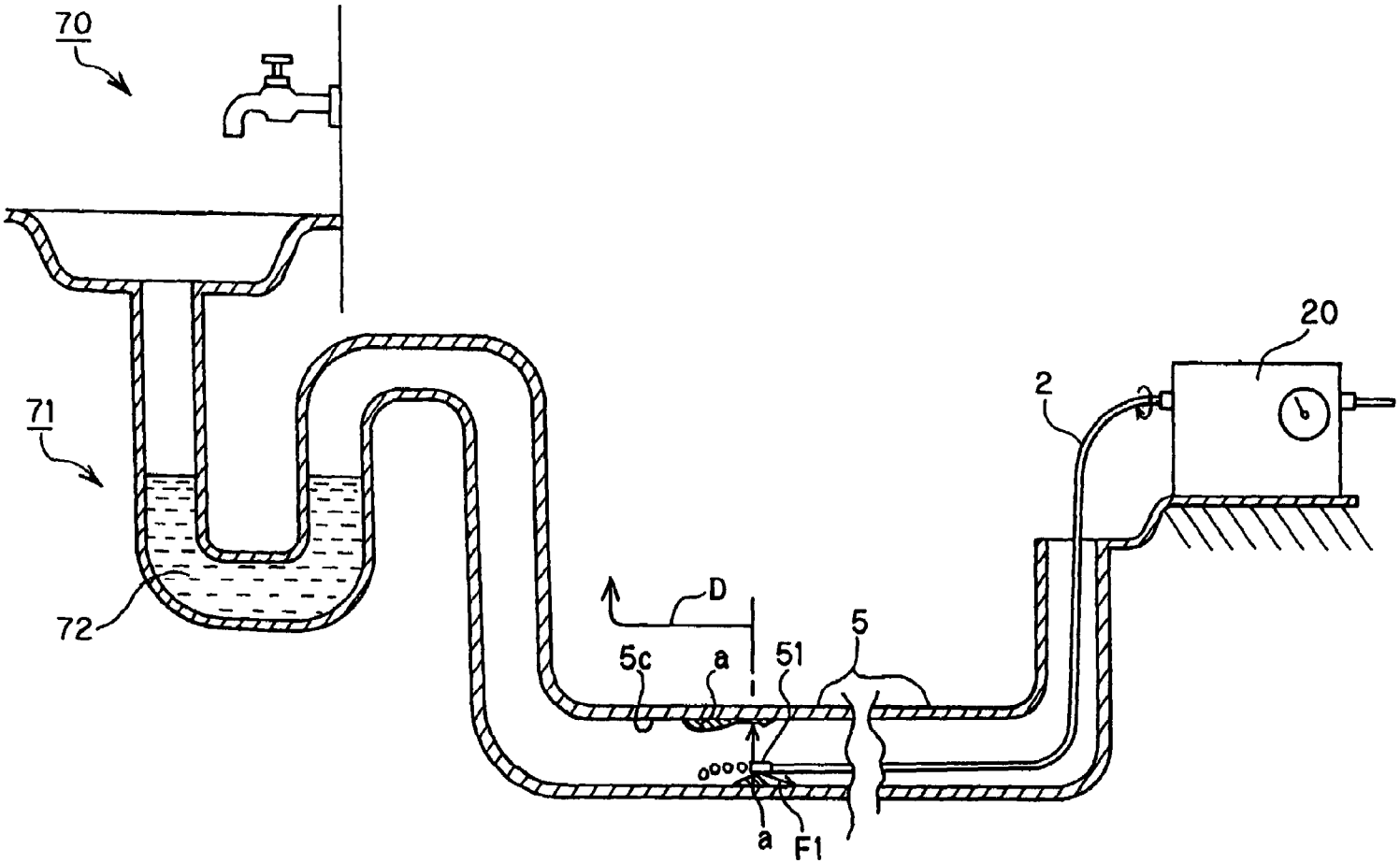
FIG. 33 is a cross-sectional view of main parts representing a drain pipe facility.
Figure 34:
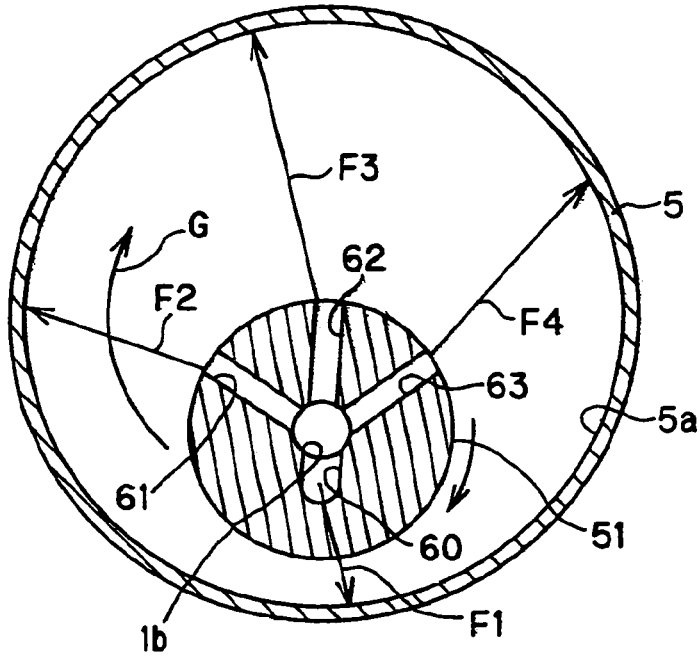
FIG. 34 is a cross-sectional view representing the operation of the third method and device for washing drain pipe of the present invention.

FIG. 33 is a cross-sectional view of main parts of a pipe facility representing the operation of the third device for washing drain pipe according to the present invention, and more particularly representing a condition wherein washing is started from a drain pipe centralized control unit performing centralized deployment control on the back end of drain pipes communicating to each apartment in a condominium building or the like toward the starting end of a horizontal drain pipe 5 that communicates with a waste water facility 70 (sink) in a particular apartment.

On the starting end side of the horizontal drain pipe 5 communicating with the waste water facility 70 (sink), a water trap valve 71 is formed by bending that drain pipe 5, in the interior whereof is retained a certain volume of trap water 72, whereby outside air, and more particularly odors and small animals and the like, are prevented from penetrating into the apartment via the drain pipe 5.

In FIG. 33, the high pressure hose 2 linked securely to the trailing end of the nozzle 51 is linked via a terminal 20 to the discharge port of a high pressure pump (not shown).

This terminal 20 performs control of a valve for turning the high pressure water supplied from the high pressure pump on and off, feeds out the high pressure hose 2 wound on a drum, rewinds the high pressure hose 2 onto the drum, and turns the high pressure hose 2. The details of this terminal 20 are disclosed in Japanese Utility Model Publication No. H56-36856.

The washing of a drain pipe 5 is performed by causing high pressure water placed under pressure by the high pressure pump (not shown) to be jetted from the injection holes 60, 61, 62, and 63 (cf. FIG. 29) of the nozzle 51 attached to the leading end of the high pressure hose 2.

More specifically, as diagrammed in FIG. 30, while breaking up and stripping away the adhering material inside the pipe that is adhering to the pipe walls in the horizontal drain pipe 5, by the jetting pressure F1 of the high pressure water jetted obliquely rearward, by the injection hole 60 of large diameter in the nozzle 51, that nozzle 51 is advanced in the direction of the arrow B inside the horizontal drain pipe 5 by the propulsive force produced by the force component F1" thereof and by the operation of extracting the high pressure hose 2.

At such time, when, from the initial position of the nozzle 51 as diagrammed in FIG. 31, the high pressure hose 2 is made to turn in one direction (clockwise) by the terminal 20, as diagrammed in FIG. 33, in conjunction therewith, that nozzle 51 tuns in the clockwise direction about a center that is the axis hole 1*b*, as indicated by the arrow.

When this nozzle 51 turns, the jetting directions of the high pressure water (F1, F2, F3, and F4) jetted from the injection holes 60, 61, 62, and 63 change, and, as a consequence, a turning force will be generated in the nozzle 51 in the direction of the arrow G, while maintaining an attitude wherewith only the injection hole 60 is pressed against the inner peripheral surface 5*a* of the pipe.

Figure 35:
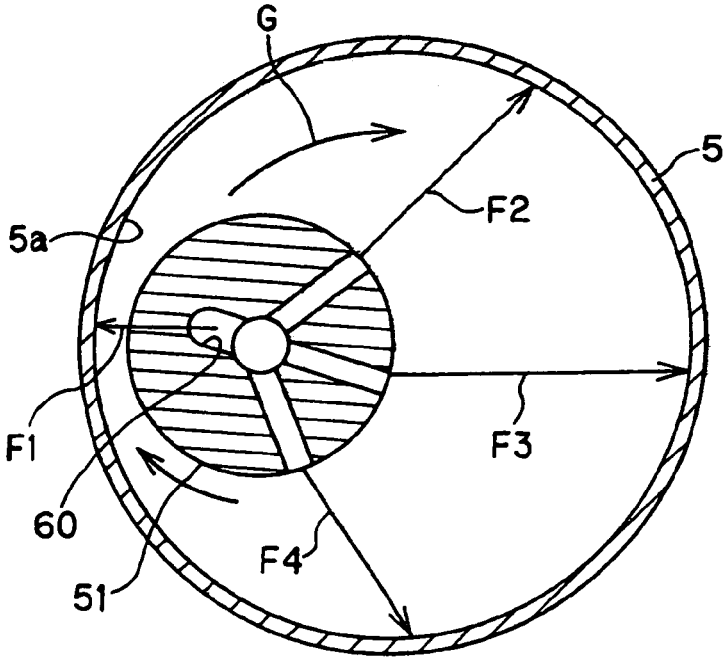
FIG. 35 is a cross-sectional view representing the operation of the third method and device for washing drain pipe of the present invention.
Figure 36:
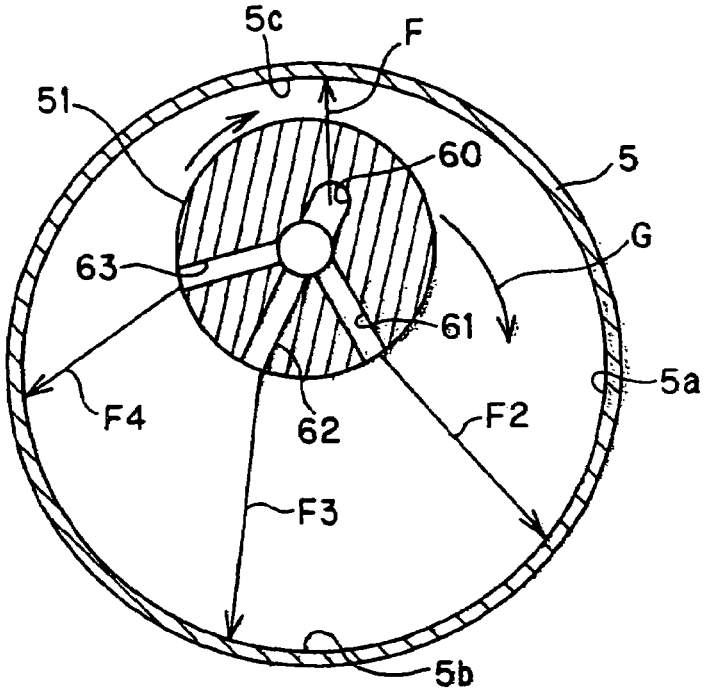
FIG. 36 is a cross-sectional view representing the operation of the third method and device for washing drain pipe of the present invention.

Thus, when the turning force is generated in the nozzle 51 in the direction of the arrow G while maintaining the attitude wherewith only the injection hole 60 is pressed against the inner peripheral surface 5*a* of the pipe, that nozzle 51 will turn inside the lateral pipe 5 while maintaining the attitude wherewith the injection hole 60 is always facing the inner peripheral surface 5*a* of the pipe, as diagrammed in FIG. 35, and the nozzle 51 will eventually arrive at a position where the injection hole 60 will face the top 5*c* of the lateral pipe 5, as diagrammed in FIG. 32.

Furthermore, at the point in time where the injection hole 60 of the nozzle 51 reaches a position where it faces the top 5*c* of the lateral pipe 5, as diagrammed in FIG. 32, if the turning of the high pressure hose 2 diagrammed in FIG. 33 is stopped, the nozzle 51 will stop turning while maintaining the attitude wherewith that injection hole 60 is facing the top 5*c* of the lateral pipe 5.

Accordingly, if the turning is stopped with the attitude maintained with the injection hole 60 of the nozzle 51 facing the top 5*c* of the lateral pipe 5, as diagrammed in FIG. 32, and thereafter the high pressure hose 2 is extracted or pulled back, either by hand or automatically, the nozzle 51 will advance along the longitudinal direction of the pipe maintained in an attitude wherewith the injection hole 60 of the nozzle 51 faces the top 5*c* of the lateral pipe 5, as a result of which it will be possible to wash the adhering material a (cf. FIG. 33) inside the pipe, adhering to the top 5*c* of the lateral pipe 5, with the high pressure water having the largest flow volume jetted from the injection hole 60, and thereby to break up and strip away the material a adhering inside that pipe.

Furthermore, when the nozzle 51 is caused to turn further in the clockwise direction about a center that is the axis hole 1*b*, as indicated by the arrow, by causing the high pressure hose 2 to turn with the terminal 20 (cf. FIG. 33), from the position of the nozzle 51 diagrammed in FIG. 32, the jetting directions of the high pressure water (F1, F2, F3, and F4) jetted from the injection holes 60, 61, 62, and 63 during that turning will again change, as diagrammed in FIG. 22, and turning will be started thereby, in the nozzle 51, in the direction of the arrow G, while maintaining an attitude wherewith only the injection hole 60 is pressed against the inner peripheral surface 5*a* of the pipe.

Figure 37:
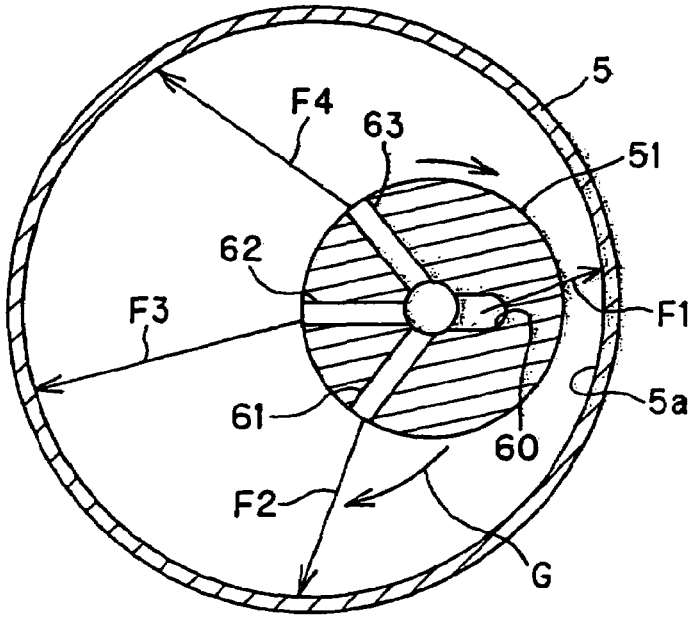
FIG. 37 is a cross-sectional view representing the operation of the third method and device for washing drain pipe of the present invention.

Thus, when turning is started, in the nozzle 51, in the direction of the arrow G, while maintaining an attitude wherewith only the injection hole 60 is pressed against the inner peripheral surface 5*a* of the pipe, that nozzle 51, as diagrammed in FIG. 37, will turn inside the lateral pipe 5 while maintaining the attitude wherewith the injection hole 60 continually faces the inner peripheral surface 5*a* of the pipe, and the nozzle 51 will eventually return to the initial position where the injection hole 60 faces the bottom 5*b* of the lateral pipe 5, as diagrammed in FIG. 31.

Figure 38:
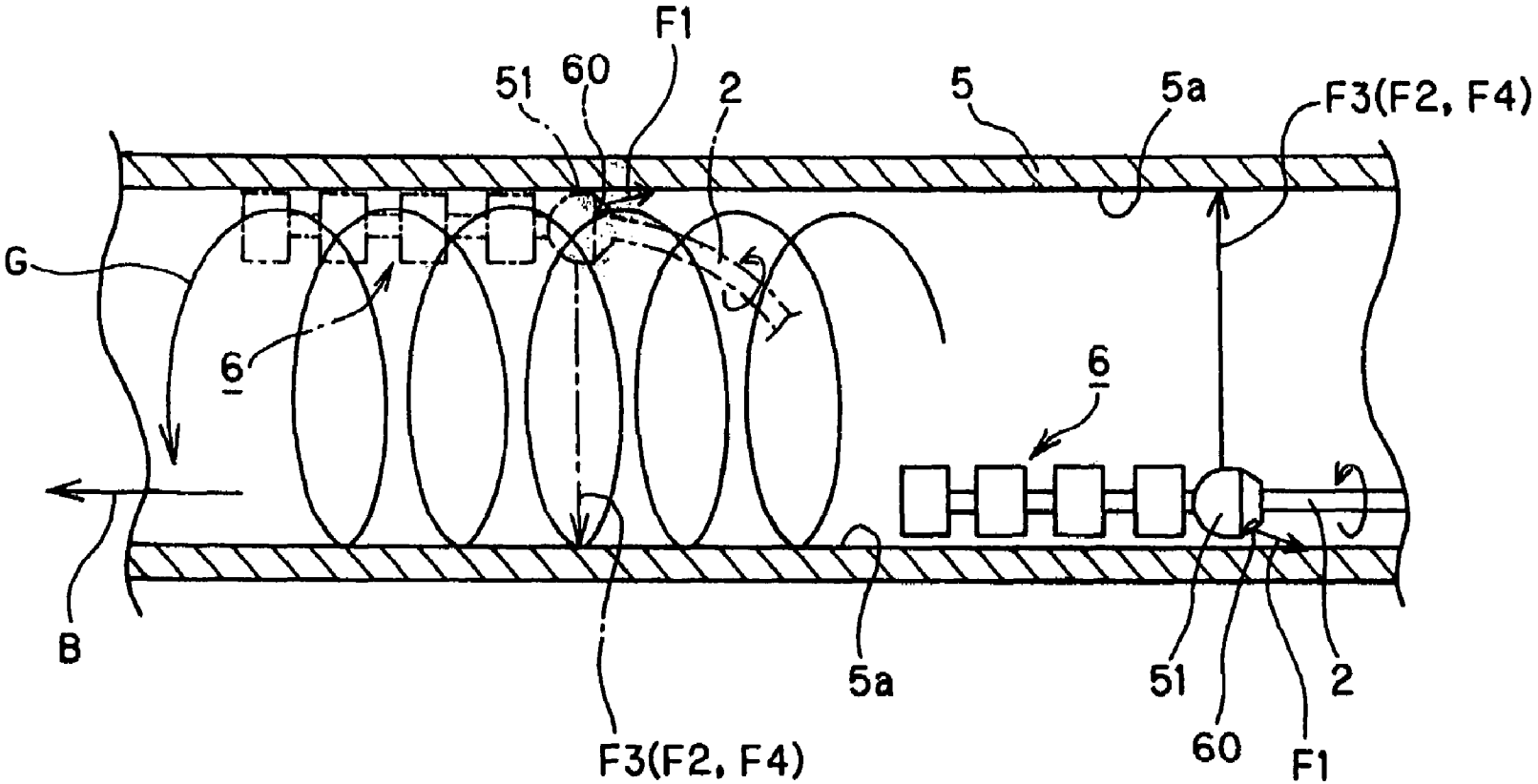
FIG. 38 is a cutaway cross-sectional view of main parts representing the operation of a nozzle in a lateral pipe.

Accordingly, inside the lateral pipe 5 in the drain pipe 21 diagrammed in FIG. 33, as diagrammed in the enlarged diagram of main parts given in FIG. 38, the high pressure hose 2 is turned by the terminal 20 (cf. FIG. 33), and the high pressure 2 is extracted, by which operation that nozzle 51 is turned in a spiral manner in the direction of the arrow G while maintaining an attitude wherewith the injection hole 60 is made to face the inner peripheral surface 5*a* of the pipe, and thereby adhering material inside the pipe that is adhering to the inner peripheral surface 5*a* of the lateral pipe 5 is efficiently broken up and stripped away by the high pressure water that is jetted with the largest flow volume.

Figure 39:
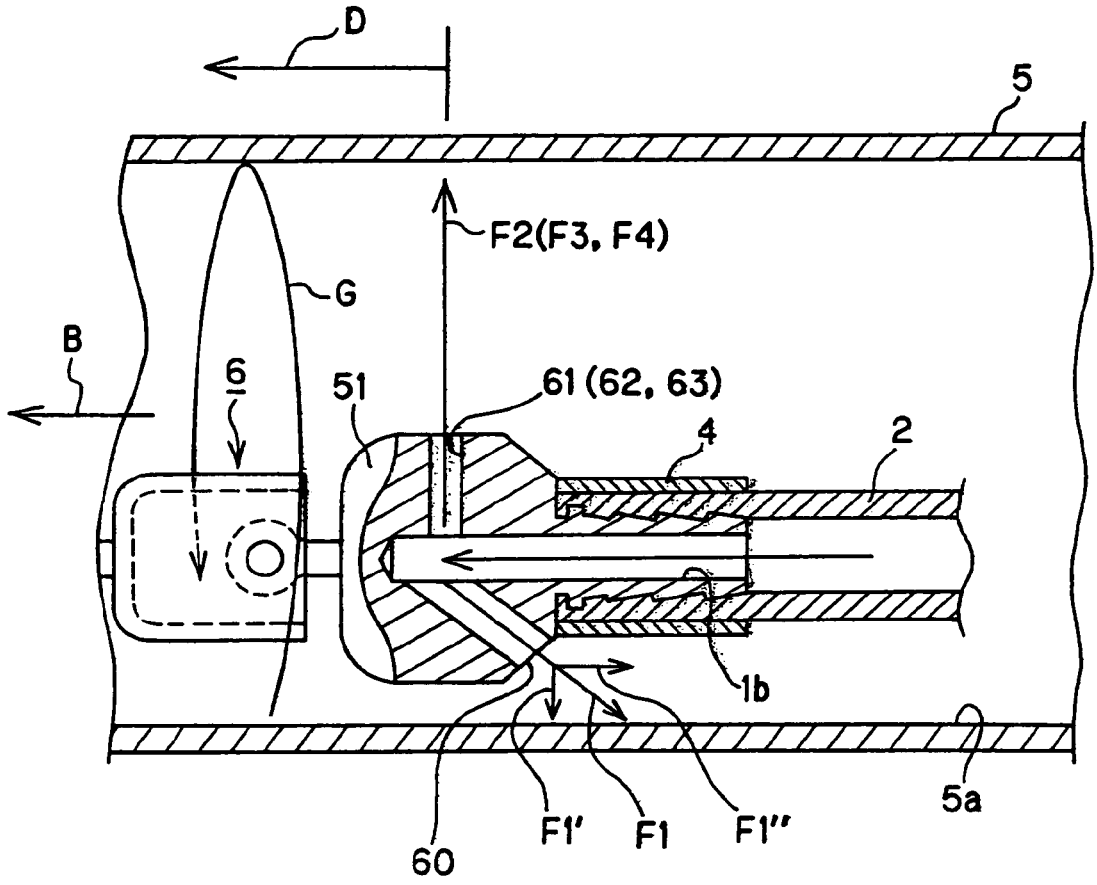
FIG. 39 is a cutaway cross-sectional view of main parts representing the operation of a nozzle in a lateral pipe.

Now, as diagrammed in FIG. 39, wherein parts identical to those in FIG. 30 are designated by the same symbols, when the nozzle 5 turns in a spiral manner, as indicated by the arrow G, along the drain pipe 5, while maintaining an attitude wherewith the injection hole 60 therein having the greatest injection volume is made to face the inner peripheral surface 5*a* of the pipe, that nozzle 51 will continually jet high pressure water (F1) obliquely rearward during that time, as a consequence whereof, due to that jetting pressure, it will try to generate a negative pressure in a region positioned in the drain pipe 5 forward of the nozzle 51 (the region indicated by the arrow D).

Meanwhile, from the other injection holes 61, 62, and 63 positioned forward of the injection hole 60, high pressure water (F2, F3, and F4) is continually jetted in a direction substantially perpendicular to the center axis line of the nozzle 51. Therefore, when the nozzle 51 turns in a spiral manner, as indicated by the arrow G, along the drain pipe 5, the high pressure water (F2, F3, and F4) jetted from those injection holes 61, 62, and 63 acts as a lid to seal, as much as possible, the region of the drain pipe 5 positioned forward of the nozzle 51 (that is, the region indicated by the arrow D). For that reason, the danger of the influence of negative pressure generated inside the drain pipe 5 by the high pressure water (F1) jetted from the injection hole 60 positioned at the back of the nozzle 51 being communicated to the region of the drain pipe 5 positioned forward of the nozzle 51 is reduced to the extent possible.

Accordingly, the generation of negative pressure in the region of the drain pipe 5 positioned forward of the nozzle 51 (region indicated by the arrow D) will be eliminated to the extent possible.

Thus, even in a case where washing is started from a drain pipe centralized control unit toward the starting end side of a horizontal drain pipe communicating to a waste water facility 70 (sink) in a certain apartment, as diagrammed in FIG. 33, the generation of negative pressure in the region of the drain pipe 5 positioned forward of the nozzle 51 (the region indicated by the arrow D) is eliminated to the extent possible, and the danger of sucking out the trap water 72 in the water trap valve 71 formed at the starting end of the horizontal drain pipe 5 that communicates with the waste water 70 (sink), and destroying the valve function thereof, is also obviated to the extent possible.

In the main vertical pipe of a drain pipe (not shown) also, by turning the high pressure hose 2 at a constant speed and extracting the high pressure hose 2, the nozzle 51 will turn in a spiral manner over the inner peripheral surface of the pipe.

At such time as this also, the nozzle 51 will turn in a spiral manner while maintaining an attitude wherewith the injection hole 60 having the greatest injection volume is made to face the inner peripheral surface of the vertical main pipe, wherefore, in a vertical pipe also, the nozzle 51 will efficiently break up and strip away adhering material inside the pipe.

Figure 40:
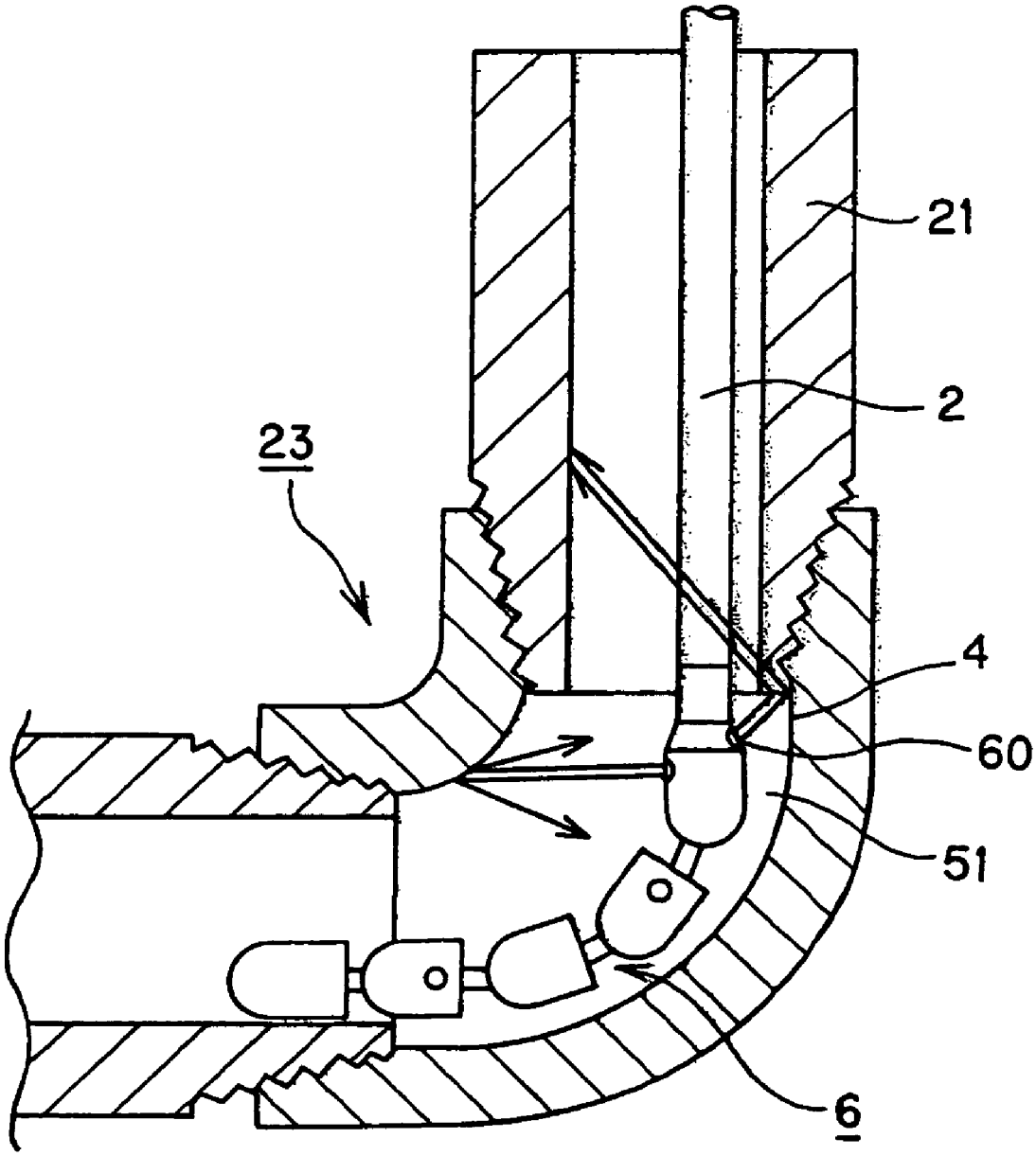
FIG. 40 is a cutaway cross-sectional view of main parts representing the operation of a nozzle in a bend in a drain pipe.

Also, as diagrammed in FIG. 28, the nozzle 51 and high pressure hose 2 are directly linked by the pressure connection socket 4, and thereby the length L between the linking end 2*a* of the high pressure hose 2 and the leading end surface 1*a* of the nozzle 51 is made short, wherefore, as diagrammed in FIG. 40, at a bend 23 in the drain pipe 21, the bendability of the high pressure hose 2 near the nozzle 51 can be improved, that is, the radius of curvature when bending can be made even smaller. Thus the nozzle 51 can pass smoothly through a bend in a drain pipe of small diameter, and can efficiently wash the bend 23 in a drain pipe of such small diameter.

Figure 41:
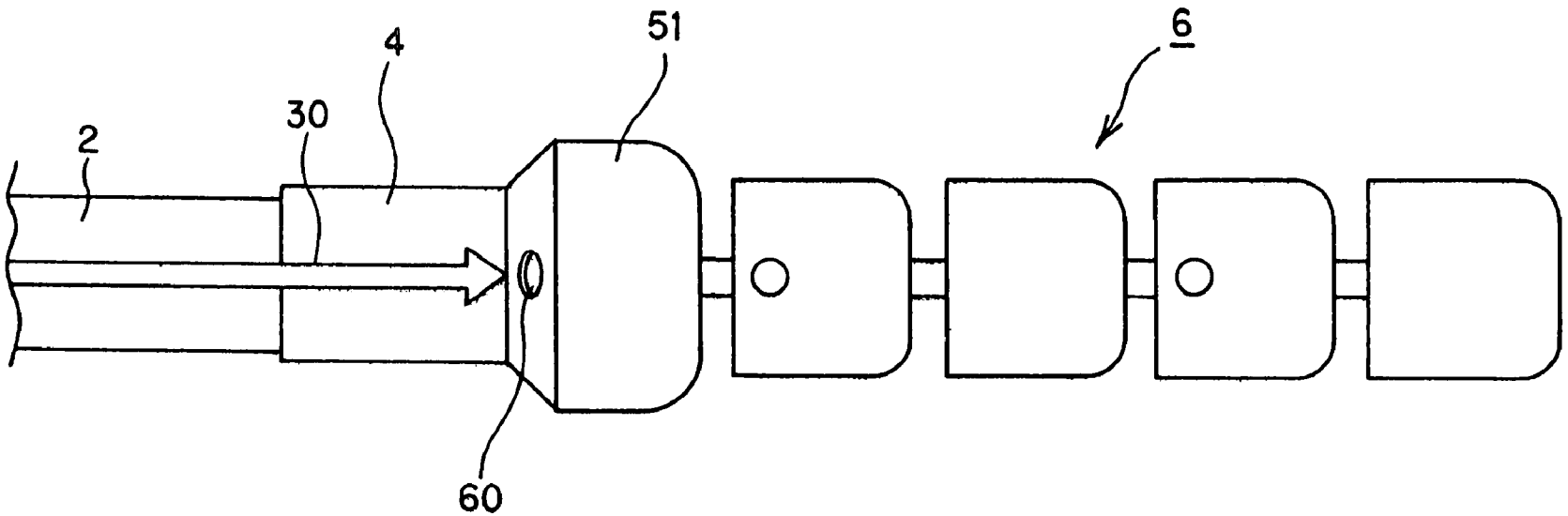
FIG. 41 is a plan of a high pressure hose representing a reference line for indicating the position of a certain injection hole.

In the embodiment described in the foregoing, furthermore, an attitude can be maintained wherewith the injection hole 60 having the greatest injection volume is always made to face the inner peripheral surface of the drain pipe. Therefor, as diagrammed in FIG. 41, for example, a reference line 30 indicating the position of the injection hole 60 is formed on the peripheral surface of the high pressure hose 2, along the longitudinal direction thereof, at a portion thereof corresponding to the injection hole 60 in the nozzle 51, thus making it possible to definitely know at which position on the inner peripheral surface of the pipe is positioned the injection hole 60 when turning the high pressure hose 2.

In the embodiment described in the foregoing, moreover, a detailed description is given for a case where four injection holes 60, 61, 62, and 63 are opened in the nozzle 51 for jetting high pressure water. However, so long as the formulas (1) and (2) given above are satisfied, neither the number of injection holes, nor the positions where they are formed, nor the sizes of the diameters thereof, etc., are limited to or by the embodiment, and various modifications are possible.

In the embodiment described above, furthermore, a detailed description is given for a case where a fluid such as water or hot water is used as the jetting medium that is jetted from the injection holes 60, 61, 62, and 63 in the nozzle 51, but the present invention is not limited to or by that embodiment, and a mixture of a fluid and a gas may be used as the jetting medium.

Thus, by using a mixture of a fluid and a gas for the jetting medium, when the jetting medium impacts the drain pipe, the gas mixed therein can blast out and further enhance the washing force thereof.

Various materials can be used for the fluid and gas making up the jetting medium, moreover. Cold water or hot water can be used for the fluid, for example, and air can be used for the gas.

As described in the foregoing, with the third pipe washing method and device of the present invention, provision is made so that, in conjunction with turning and extracting the high pressure hose, the nozzle is made to turn in a spiral manner, so that, of the plurality of injection holes, only a certain injection hole will always face the inner peripheral surface of the pipe, and provision is made further so that the diameter of the certain injection hole is made larger than the diameters of the other injection holes, so that the position of that certain injection hole is made farther rearward than the positions of the other injection holes as seen from the direction of advance of the nozzle, so that the angle $\alpha$ subtended between the center axis line I of that certain injection hole and the center axis line H of the nozzle is made an acute angle, and so that the angle $\beta$ subtended between the center axis lines J of the other injection holes and the center axis line H of the nozzle, respectively, are made substantially 90 degrees. Therefore, not only is it possible, by the turning of the nozzle, to efficiently break up and wash away the adhering material sticking fast to all parts of the periphery of the pipe walls by the high pressure water jetted with large flow volume from the certain injection hole of large diameter, but also, because provision is made so that a negative pressure is not generated in a region of the drain pipe positioned forward of the nozzle, washing can be done efficiently, and without destroying the water trap valve deployed in a drain pipe communicating to a sink or other waste water facility.

INDUSTRIAL APPLICABILITY

As described in the foregoing, the method and device for washing drain pipe according to the present invention is particularly suitable for washing lateral pipes in drain pipes and other pipeline facilities installed in condominium buildings and other types of buildings.

The invention claimed is:

1. A method of washing drain pipe in which a nozzle is provided at leading end of a high pressure hose connected to a terminal hose control, a universal guide is linked to leading end of the nozzle, high pressure water is jetted from a plurality of injection holes opened in the nozzle, the high pressure hose is fed into the drain pipe while causing the high pressure hose to turn, and an interior of the pipe is washed by the high pressure water jetted from the nozzle, wherein:

the nozzle is made to turn in a spiral movement in conjunction with turning, pulling out, and pulling back of the high pressure hose, by setting a jet pressure of high pressure water injected from a first plurality of injection holes to the interior of the pipe, said first plurality of injection holes comprising a first injection hole and a second plurality of injection holes, said first injection hole being larger than each of said second plurality of injection holes, said second plurality of injection holes being on a side of the pipe opposite said first injection hole, whereby, the first injection hole of the plurality of injection holes is pushed against an inner peripheral surface of the pipe, when the high pressure water is injected from the first plurality of injections holes so that, of the first plurality of injection holes, the first injection hole is always facing and pressed against the inner peripheral surface of the pipe;

angle $\alpha$ subtended by center axis line I of the certain injection hole and center axis line H of the nozzle is substantially 90 degrees, and angle $\beta$ subtended by a center axis line J of other injection holes and a center axis line H of the nozzle, respectively, is substantially 90 degrees.

2. The method of washing drain pipe according to claim 1, wherein the high pressure water is hot water.

3. The method of washing drain pipe according to claim 1, wherein the nozzle and the high pressure hose are directly linked by means of a pressure connection socket.

4. The method of washing drain pipe according to claim 1, wherein a reference line is placed on the surface of the high pressure hose indicating a position of the first injection hole, along the longitudinal direction of the high pressure hose.

5. A method of washing drain pipe in which a nozzle is provided at leading end of a high pressure hose connected to a terminal hose control, a universal guide is linked to a leading end of the nozzle, high pressure water is jetted from a plurality of injection holes opened in the nozzle, the high pressure hose is fed into the drain pipe while causing the high pressure hose to turn, and an interior of the pipe is washed by the high pressure water jetted from the nozzle, wherein:

the nozzle is made to turn in a spiral movement along inner peripheral surface of the pipe, in conjunction with turning and feeding out the high pressure hose, by setting a jet pressure of high pressure water injected from a first plurality of injection holes to the interior of the pipe, said first plurality of injection holes comprising a first injection hole and a second plurality of injection holes, said first injection hole being larger than each of said second plurality of injection holes, said second plurality of injection holes being on a side of the pipe opposite said first injection hole, whereby, first injection hole of the plurality of injection holes is pushed against an inner peripheral surface of the pipe when the high pressure water is injected from the first plurality of injections holes so that, of the first plurality of injection holes, the first injection hole is always facing and pressed against the inner peripheral surface of the pipe;

a position of the first injection hole is made farther rearward than positions of other injection holes as seen from direction of advance of the nozzle;

angle $\alpha$ subtended by center axis line I of the first injection hole and center axis line H of the nozzle is made an acute angle; and angle $\beta$ subtended by center axis line J of each of the second plurality of injection holes and a center axis line H of the nozzle, respectively, is substantially 90 degrees.

6. A method of washing a drain pipe in which a nozzle is provided at leading end of a high pressure hose connected to a terminal hose control, a universal guide is linked to a leading end of the nozzle, jetting medium is jetted from a first plurality of injection holes opened in the nozzle, the high pressure hose is fed into the drain pipe while causing the high pressure hose to turn, and an interior of the pipe is washed by the jetting medium jetted from the nozzle, wherein:

the jetting medium comprises a mixture of a fluid and a gas;

the nozzle is made to turn in a spiral movement along inner peripheral surface of the pipe, in conjunction with turning, pulling out, and pulling back the high pressure hose, by setting a jet pressure of high pressure water injected from the first plurality of injection holes to the interior of the pipe, said first plurality of injection holes comprising a first injection hole and a second plurality injection holes, said first injection hole being larger than each of said second plurality of injection holes, said second plurality of injection holes being on a side of the pipe opposite said first injection hole, whereby, the first injection hole of the first plurality of injection holes is pushed against an inner peripheral surface of the pipe, when the high pressure water is injected from the first plurality of injections holes so that, of the first plurality of injection holes, the first injection hole is always facing and pressed against the inner peripheral surface of the pipe;

angle $\alpha$ subtended by center axis line I of the certain injection hole and center axis line H of the nozzle is substantially 90 degrees, and angles $\beta$ subtended by a center axis line J of other injection holes and a center axis line H of the nozzle, is substantially 90 degrees.

7. A method of washing drain pipe in which a nozzle is provided at leading end of a high pressure hose connected to a terminal hose control, a universal guide is linked to a leading end of the nozzle, jetting medium is jetted from a plurality of injection holes opened in the nozzle, the high pressure hose is fed into the drain pipe while causing the high pressure hose to turn, and an interior of the pipe is washed by the jetting medium jetted from the nozzle wherein:

the jetting medium comprises a mixture of a fluid and a gas;

the nozzle is made to turn in a spiral movement in conjunction with turning and feeding out the high pressure hose, by setting a jet pressure of high pressure water injected from the first plurality of injection holes to the interior of the pipe, said first plurality of injection holes comprising a first injection hole and a second plurality of injection holes, said first injection hole being larger than each of said second plurality of injection holes, said second plurality of injection holes being on a side of the pipe opposite said first injection hole, whereby, the first injection hole of the plurality of injection holes is pushed against an inner peripheral surface of the pipe, when the high pressure water is injected from the first plurality of injections holes so that, of the first plurality of injection holes, the first injection hole is always facing and pressed against the inner peripheral surface of the pipe;

the position of the first injection hole is farther rearward than positions of the second plurality of injection holes as seen from direction of advance of the nozzle;

angle $\alpha$ subtended by a center axis line I of the certain injection hole and a center axis line H of the nozzle is an acute angle; and angles $\beta$ subtended by center a axis line J of other injection holes and a center axis line H of the nozzle, respectively, are each substantially 90 degrees.

* * * * *